US011702252B2

(12) United States Patent
Gosling et al.

(10) Patent No.: US 11,702,252 B2
(45) Date of Patent: Jul. 18, 2023

(54) TAMPER-EVIDENT CLOSURE FOR CONTAINER

(71) Applicant: Cheer Pack North America LLC, West Bridgewater, MA (US)

(72) Inventors: Steve Gosling, West Bridgewater, MA (US); Peter J. Walters, West Bridgewater, MA (US); David Williamson, West Bridgewater, MA (US)

(73) Assignee: Cheer Pack North America LLC, West Bridgewater, MA (US)

( * ) Notice: Subject to any disclaimer, the term of this patent is extended or adjusted under 35 U.S.C. 154(b) by 0 days.

(21) Appl. No.: 17/477,776

(22) Filed: Sep. 17, 2021

(65) Prior Publication Data

US 2023/0087314 A1 Mar. 23, 2023

(51) Int. Cl.

| | |
|---|---|
| ***B65D 41/34*** | (2006.01) |
| ***B65D 75/58*** | (2006.01) |
| ***B65D 47/32*** | (2006.01) |

(52) U.S. Cl.

CPC ..... *B65D 41/3404* (2013.01); *B65D 47/32* (2013.01); *B65D 75/5883* (2013.01); *B65D 2213/00* (2013.01)

(58) Field of Classification Search

CPC ..... B65D 41/3409; B65D 41/3428; B65D 41/3404; B65D 41/34; B65D 41/62;

(Continued)

(56) References Cited

U.S. PATENT DOCUMENTS 5,512,228 A 4/1996 Adams et al.
D467,501 S 12/2002 Tacchella (Continued)

FOREIGN PATENT DOCUMENTS

EP 2870076 B1 5/2016
FR 2251193 A * 7/1975 ..... B65D 41/485

(Continued)

OTHER PUBLICATIONS

Hoffer Plastics, "Trust-T-Lok Family of Tamper Evident Closures," retrieved from the Internet at https://hofferplastics.com/products/trust-t-lok/, on Aug. 1, 2022 (8 pages).

(Continued)

*Primary Examiner* — Robert J Hicks
(74) *Attorney, Agent, or Firm* — Nutter McClennen & Fish LLP

(57) ABSTRACT

A closure for a container. The closure include an outer shell having a proximal end, a distal end, an inner surface, and an outer surface. The closure also including an inner cap having a proximal end, a distal end, an inner surface, and an outer surface. A plurality of ribs extend from the inner cap to the outer shell. A tamper-evident band encircles the distal end of the inner cap. The tamper-evident band includes a plurality of tamper-evident segments. Each tamper-evident segment has a tab coupled with one of the plurality of ribs and a break segment. A first end of the break segment is coupled with the tab and a second end of the break segment is coupled with an adjacent one of the plurality of ribs.

22 Claims, 26 Drawing Sheets

(58) Field of Classification Search
CPC ..... B65D 47/32; B65D 75/5883; B65D 75/5872; B65D 75/5866; B65D 75/5861
USPC ..... 215/252, 251, 250, 229, 228; 220/266, 220/265, 709, 705, 212
See application file for complete search history.

(56) References Cited

U.S. PATENT DOCUMENTS

| | | | |
|---|---|---|---|
| D547,657 | S | 7/2007 | Tacchella |
| D552,483 | S | 10/2007 | Rigardo |
| D679,597 | S | 4/2013 | Tamarindo |
| D684,058 | S | 6/2013 | Kwon |
| 8,528,757 | B2 | 9/2013 | Bisio |
| D717,650 | S | 11/2014 | Tamarindo |
| 8,950,939 | B2 | 2/2015 | Last et al. |
| 9,016,473 | B2 | 4/2015 | Tamarindo |
| D735,038 | S | 7/2015 | Tamarindo |
| 9,187,217 | B2 | 11/2015 | Bisio |
| 9,290,306 | B2 | 3/2016 | Totten |
| 9,446,158 | B2 | 9/2016 | Laguzzi |
| D775,532 | S | 1/2017 | Basson |
| 9,708,095 | B2 | 7/2017 | Rosselli |
| D799,322 | S | 10/2017 | Tamarindo |
| 9,782,502 | B2 | 10/2017 | Laguzzi |
| 10,202,225 | B2 | 2/2019 | Tamarindo |
| D842,699 | S | 3/2019 | Tamarindo |
| 10,232,985 | B2 | 3/2019 | Bisio |
| 10,245,336 | B2 | 4/2019 | Tamarindo |
| 10,472,133 | B2 | 11/2019 | Tamarindo |
| 10,588,990 | B2 | 3/2020 | Tamarindo |
| D885,893 | S | 6/2020 | Tamarindo |
| 10,710,753 | B2 | 7/2020 | Tamarindo |
| D905,072 | S | 12/2020 | Buzzi |
| 10,934,038 | B2 | 3/2021 | Last |
| 2012/0211460 | A1* | 8/2012 | Tamarindo ..... B65D 41/0485 215/329 |
| 2014/0010481 | A1 | 1/2014 | Last et al. |
| 2015/0129533 | A1* | 5/2015 | Taber ..... B65D 41/3419 215/256 |
| 2015/0232237 | A1 | 8/2015 | Berge et al. |
| 2018/0170626 | A1 | 6/2018 | Kwon |
| 2019/0106233 | A1 | 4/2019 | Tamarindo |
| 2019/0168924 | A1 | 6/2019 | Tamarindo |
| 2019/0202605 | A1 | 7/2019 | Bisio |
| 2020/0262635 | A1 | 8/2020 | Buzzi et al. |

FOREIGN PATENT DOCUMENTS

| | | | | |
|---|---|---|---|---|
| GB | 849578 | A * | 9/1960 | ..... B65D 41/34 |
| WO | WO-2007117897 | A2 * | 10/2007 | ..... B65D 41/485 |
| WO | 2012/028980 | A1 | 3/2012 | |
| WO | 2019/229561 | A1 | 12/2019 | |

OTHER PUBLICATIONS

Menshen, "Weldspouts Comprehensive Standard Program and Powerful Partner for Customter Specific Developments," retrieved from the internet at https://www.menshen.com/portfolio/weldspouts/, on Aug. 1, 2022 (7 pages).

Scholle IPN, "ArrowCap CS85+CC85AR," retrieved from the internet at https://www.scholleipn.com/products/arrowcap-cs85-rl-cc85ar/, on Aug. 2, 2022 (9 pages).

International Search Report and Written Opinion for International Application No. PCT/US2022/039426, dated Nov. 10, 2022, 12 pages.

* cited by examiner

TAMPER-EVIDENT CLOSURE FOR CONTAINER

FIELD

The present disclosure generally relates to tamper-evident closures for containers and related methods. For example, closures of the present disclosure can be used in conjunction with pouches or other containers that hold perishable food.

BACKGROUND

Various closures have been used to seal flexible pouches containing liquids, pastes, gels and similar products. Some closures are designed for single use, meaning that once the closure is opened or removed, the contents are to be fully consumed and the closure is not designed to be placed back on the opening or spout. However, some closures are designed to re-seal the opening and to preserve the contents remaining the pouch. For resealable closures, there is often no visual indication that the cap was partially or completely removed and then placed back onto the spout. This presents a safety hazard as customers would like to know if the contents are fresh, have been exposed to the atmosphere, or if they have been tampered with.

Among other things, the flexible pouches may be part of a fruit juice containers normally used by children. Different countries have varying child safety regulations intended to prevent choking by children. These regulations tend to provide restrictions on the dimensions of the cap so as to prevent the possibility that the caps are swallowed by the children.

SUMMARY

The systems, devices, and methods provided for in the present disclosure relate to a closure for a container. The closure has an outer shell having a proximal end, a distal end, an inner surface, and an outer surface. The closure also has an inner cap having a proximal end, a distal end, an inner surface, and an outer surface. The closure includes a plurality of ribs extending from the inner cap to the outer shell. Furthermore, a tamper-evident band surrounds the distal end of the inner cap. The tamper-evident band includes a plurality of tamper-evident segments. The tamper-evident segment has a tab coupled with one of the plurality of ribs. The tamper-evident segment also has a second end coupled with a first end of a break segment. A second end of the break segment is coupled with an adjacent one of the plurality of ribs.

In some embodiments, the tab of each of the plurality of tamper-evident segments is configured to pivot about a vertical axis, the vertical axis defined by the rib that is coupled to the first end of the tab, when the outer shell is rotated relative to the inner cap. Furthermore, a distal end of the outer shell may be proximal to the tamper-evident band. In various embodiments, the closure may include between two tamper-evident segments and four segments.

In various embodiments, a ratio of a maximum height of the outer shell to a height of one of the plurality of tabs is less than or equal to 6:1, such as 3:1. For example, in some embodiments, the tabs may have a height that is that is approximately the same height as the outer shell. A height of each of the tabs may be substantially equal to or greater than a distance from a distal end of the outer shell to a proximal end of the outer shell as measured along a proximal-distal axis of the closure.

Among other things, each of the tabs may include a recessed portion at the first end thereof, the recessed portion connecting the tab to the one of the plurality of ribs. The recessed portion may form a hinge. Furthermore, each of the tabs may include at least one lug extending inwardly (e.g., radially inwardly) towards the inner cap. The at least one lug may be configured to engage the container to oppose relative rotation between the tamper-evident band and the container.

Each tab may be formed integrally with the rib coupled to the first end of the tab. In various embodiments, the break segment is a tear strip. Additionally, or alternatively, the break segment may be coupled at the second end of each tab. Among other shapes, the tabs may have an arcuate, straight, substantially straight, faceted, or semi-circular, shape leading to the break segment. In some embodiments, the inner surface of the inner cap is at least partially threaded.

In accordance with yet another embodiment, a closure for a container includes an outer shell. The outer shell has a proximal end, a distal end, an inner surface, and an outer surface. The closure also includes an inner cap having a proximal end, a distal end, an at least partially threaded inner surface, and an outer surface. A plurality of ribs extend from the inner cap to the outer shell. Each of the plurality of ribs extending tangentially from an outer surface of the inner cap towards the inner surface of the outer shell. A tamper-evident band at least partially surrounds the distal end of the inner cap. The tamper-evident band is made up of a plurality of tamper-evident segments. Each tamper-evident segment has a tab coupled at a first end to one of the plurality of ribs, and a break segment extending between the tab and another one of the plurality of ribs.

Various embodiments may include four ribs. Regardless of the number of ribs, each of the plurality of ribs may extend along the inner surface of the outer shell from the proximal end to the distal end of the outer shell. Furthermore, each of the plurality of ribs may extend along the outer surface of the inner cap from the proximal end of the inner cap to the distal end of the inner cap. In some embodiments, each tab pivots about a vertical axis of the rib to which the first end of the tab is coupled when the outer shell is rotated relative to the inner cap.

In accordance with yet another embodiment, a closure for a container includes an outer shell having a proximal end, a distal end, an inner surface, and an outer surface. An inner cap has a proximal end, a distal end, an inner surface, and an outer surface. A plurality of ribs extend from the inner cap to the outer shell. A tamper-evident band circumvents the distal end of the inner cap. The tamper-evident band is made up of a plurality of tamper-evident segments. Each tamper-evident segment has a tab coupled at a first end to one of the plurality of ribs, and a break segment extending between the tab and another one of the plurality of ribs. A ratio of a maximum height of the outer shell, as measured along a proximal-distal axis, to a height of one of the plurality of tabs as measured along the proximal-distal axis is less than or equal 6:1. In various embodiments a ratio of a maximum height of the outer shell, as measured along a proximal-distal axis, to a height of one of the plurality of tabs as measured along the proximal-distal axis is less than or equal 3:1.

In some embodiments, the ratio of the maximum height of one of the plurality of tabs to the height of the outer shell is approximately 1:1. In various embodiments, the distal end of the outer shell terminates proximally of a proximal end of the tab. Additionally, the tamper-evident band may be distal to the distal end of the outer shell.

BRIEF DESCRIPTION OF DRAWINGS

This disclosure will be more fully understood from the following detailed description taken in conjunction with the accompanying drawings, in which.

DETAILED DESCRIPTION

Illustrative embodiments provide an improved tamper-evident container. The container includes a straw and a cap. The straw and the cap may be provided in a sealed configuration. Upon application of sufficient force, the straw and the cap become separable. The cap includes one or more tamper-evident tabs that have a large height for easy identification that the container is in a separable configuration (i.e., that the cap and the straw are no longer in a sealed configuration). To that end, the tab may include a hinge that causes the tab to swing outwardly for further ease of identification (also referred to as the tabs being in an open configuration). Furthermore, various embodiments include a plurality of ribs that extending tangentially outwardly from a central hub. The inventors believe that the tangential rib arrangement provides a more robust cap, even when the ribs are made thinner. Making the ribs thinner advantageously reduces material, material cost, and also provides a more environmentally-friendly design.

Certain exemplary embodiments will now be described to provide an overall understanding of the principles of the structure, function, manufacture, and use of the devices, systems, and methods disclosed herein. One or more examples of these embodiments are illustrated in the accompanying drawings. The devices, systems, and methods specifically described herein and illustrated in the accompanying drawings are non-limiting embodiments. The features illustrated or described in connection with one embodiment may be combined with the features of other embodiments. Such modifications and variations are intended to be included within the scope of the present disclosure. Additionally, to the extent that linear or circular dimensions are used in the description of the disclosed devices and methods, such dimensions are not intended to limit the types of shapes that can be used in conjunction with such devices and methods. Equivalents to such linear and circular dimensions can be determined for different geometric shapes. Further, like-numbered components of the embodiments can generally have similar features. Still further, sizes and shapes of the devices, and the components thereof, can depend at least on the anatomy of the subject in which the devices will be used, the size and shape of objects with which the devices will be used, and the methods and procedures in which the devices will be used.

Figure 1:
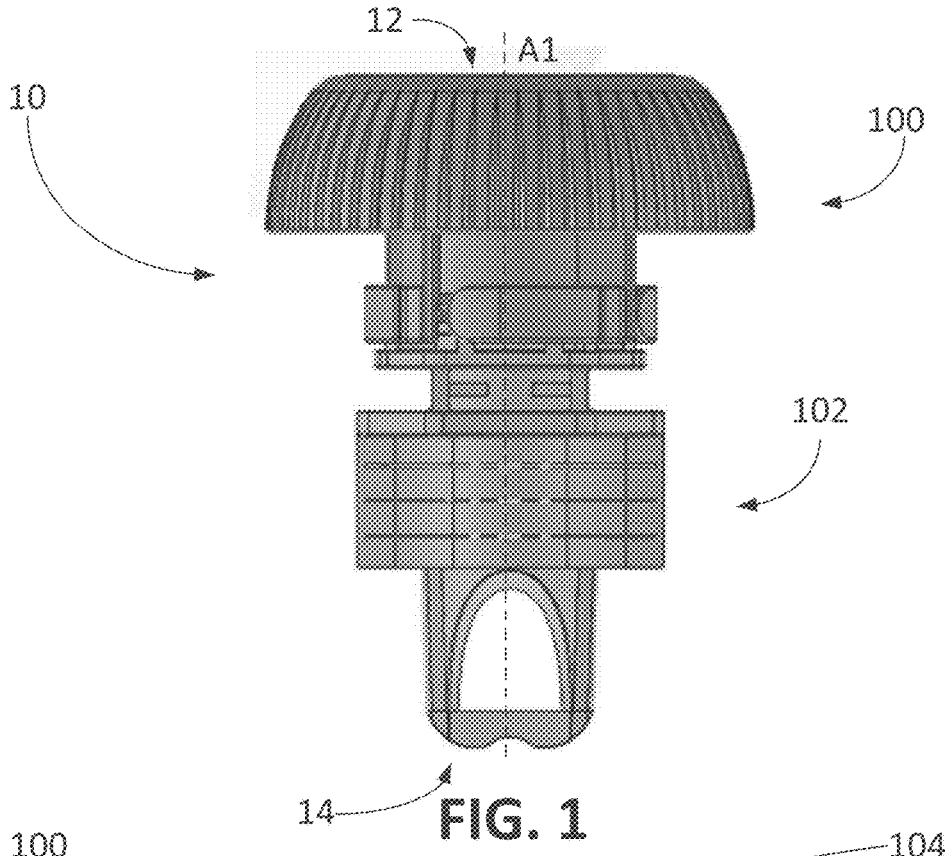
FIG. 1 is a front view of one embodiment of a closure of the present disclosure coupled to a straw of a container.

FIGS. 1-10 illustrate one embodiment of a closure 100 (also referred to as a cap) of the present disclosure. FIG. 1 shows a distal end of the cap 100 coupled to a straw 102 that can form part of a larger container (not shown). The cap 100 can seal or close the container and can provide a visible indication to a user when the cap has been unsealed, opened, or otherwise tampered with. Together, the cap 100 and the straw 102 form a device 10 having a proximal end 12 and a distal end 14 relative to a longitudinal axis A1 of the device 10. In some embodiments, the device 10 may be integrated into a flexible pouch configured to house a fluid, such as baby food, fruit puree and snacks, sauces and dressings, and/or coffee.

Figure 2:
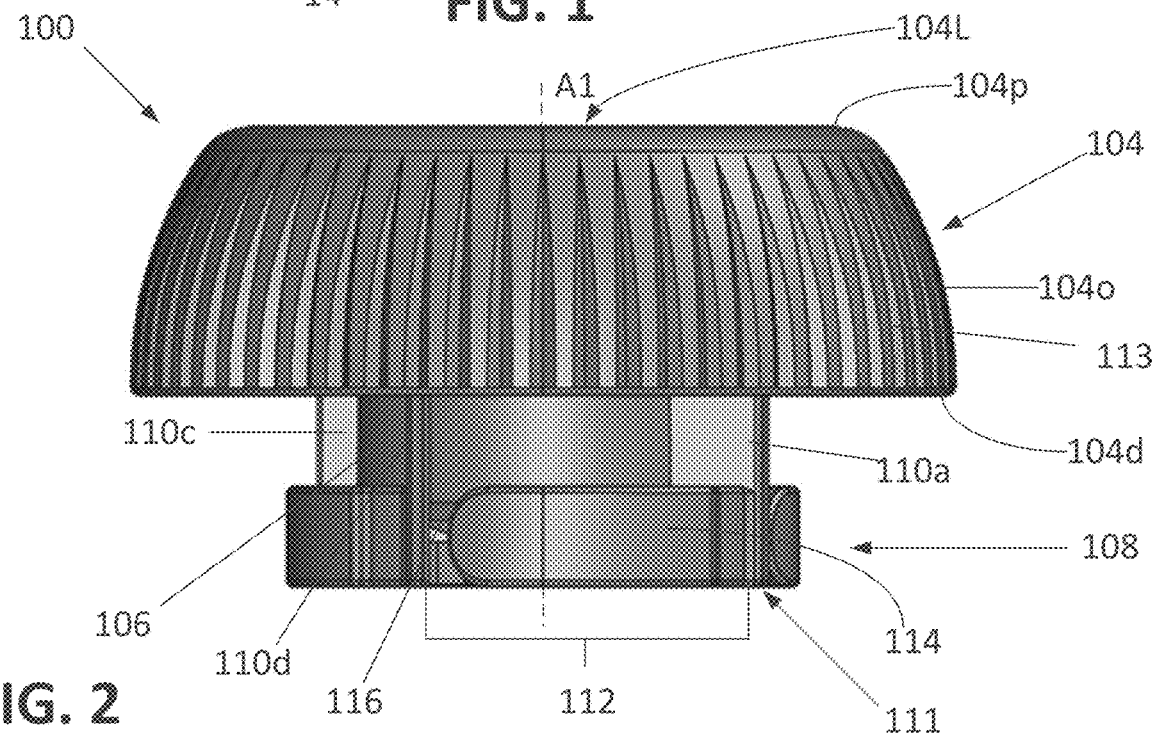
FIG. 2 is a front view of the closure of FIG. 1.
Figure 3:
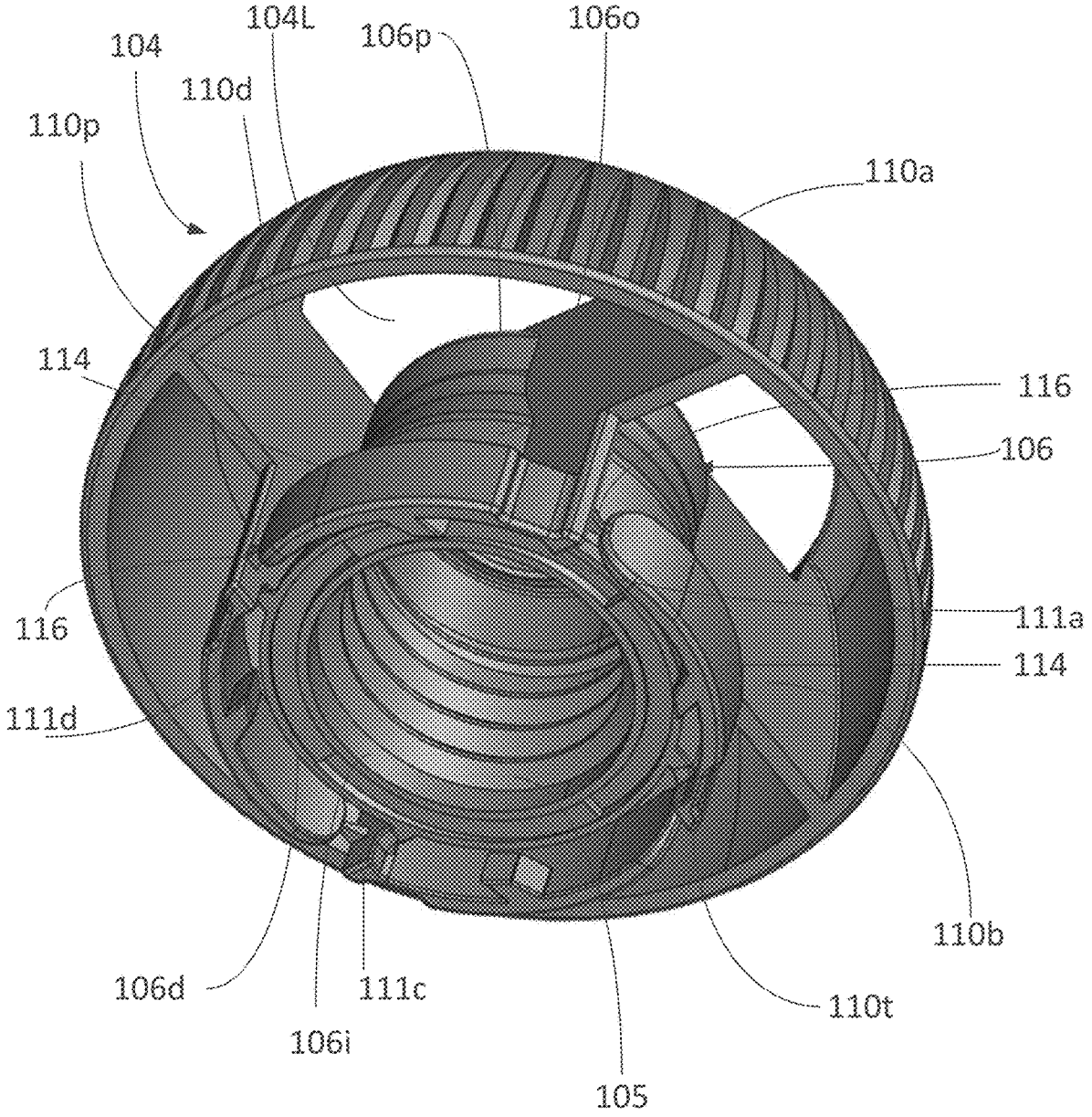
FIG. 3 is a bottom perspective view of the closure of FIG. 1.

With further reference to FIGS. 2 and 3, the cap 100 can include an outer shell 104, an inner cap 106, and a tamper-evident band 108. One or more ribs 110 can extend between the inner cap 106 and the outer shell 104. The tamper-evident band 108 can encircle or surround at least a portion of the inner cap 106 and can be formed at a distal portion 110*t* (e.g., at or substantially at a distal end 111) of the one or more ribs 110. As discussed in detail below, the tamper-evident band 108 can include one or more tamper-evident segments 112. In various embodiments the tamper-evident segments 112 may substantially surround the cap 100 (e.g., one tamper-evident segment 112 that extends about 360 degrees, two tamper-evident segments that each extend about 180 degrees, etc.) Each tamper-evident segment 112 can include a tab or flag 114 and a break segment 116. The tamper-evident band 108 is formed such that rotation of the outer shell 104 relative to the straw 102 causes the tab 114 of one or more of the tamper-evident segments 112 to deform and pivot about one of the ribs 110. More particularly, the tab 114 can pivot about a proximal-distal axis A1 of the rib 110 in a manner visible to a user. Tabs of the present disclosure can be constructed to clearly indicate to a user that the cap 100 has been opened or tampered with. For example, and as discussed in detail further below, caps 100 of the present disclosure can include tabs 114 having a height Ht, as measured along a central longitudinal axis A1 (also referred to as a proximal-distal axis A1), that can be a larger percentage of a height Ho of the outer shell 104 than currently available caps. The components of the cap 100 will now be described in greater detail with reference to FIGS. 1-10.

The outer shell 104 can have a proximal end 104*p* and a distal end 104*d* with a central lumen 104L extending therebetween. An outer surface 104*o* of the outer shell 104 can be gripped by a user and rotated to open the cap 100. In some embodiments, the outer surface 104*o* of the outer shell 104 can include one or more features that can aid a user in gripping the cap 100. For example, the outer shell 104 can have a convex profile and/or can include gripping features such as ridges or grooves 113. The distal end 104*d* of the outer shell 104 can terminate proximal to the tamper-evident band 108 such that the entirety of the tamper-evident band 108 can be visible to a user.

In some embodiments, the height Ht of the tab 114 can be about, or greater than, $1/6^{th}$ of the height Ho of the outer shell 104, as measured from the proximal end 104*p* to the distal end 104*d* of the outer shell 104 along the proximal-distal axis A1. Accordingly, illustrative embodiments have a 6:1 ratio, or smaller (e.g., 5.5:1, 4:1, 3:1, 2:1, 1:1), of height Ho of the outer shell to the height Ht of tab. The inventors have found that this relatively large tab height (as compared to outer shell height Ho) advantageously provides ease of visualization for tamper evidence. Indeed, some embodiments may have the height Ht of the tab 114 about, or greater than, $1/3^{rd}$ of the height Ho of the outer shell 104. In other words, illustrative embodiments may have a 3:1, or smaller, ratio of height Ho of the outer shell to height Ht of tab. The inventors believe that tabs having a height of ⅓ or greater of the height of the outer cap provide quick and easy visualizations for tamper evidence. In various embodiments, the height Ho of the outer shell may have a height that is a maximum of four times larger than the height Ht of the tab 114, about three times larger than the height Ht of the tab 114, about two times larger than the height Ht of the tab 114, or about the same as the height Ht of the tab 114. Thus, as compared to prior art tabs, the height Ht of the tab 114 can be relatively large compared to the height Ho of the outer shell 104. This may provide a small distance D between the distal end 104*d* of the outer shell 104 and a proximal end 106*p* of the tab 114, such that deformation of the tab 114 is easily visible to a user. Indeed, in some embodiments, the distance D may be non-zero, or the distal end 104*d* of the outer shell 104 and the proximal end 106*p* of the tab 114 may overlap.

In illustrative embodiments the height Ho of the outer shell 104 is non-zero. As described previously, the outer shell 104 allows a user to grip and twist the cap, and therefore, preferably has a height sufficient to allow for grasping by a user's fingers. Thus, while various embodiments refer to a maximum ratio of the height Ho of the outer shell to the height Ht of tab, it should be understood by one skilled in the art that these ratios may include a non-zero bound. In various embodiments, the lower limit of the ratio may be bounded by practical user considerations and/or manufacturing considerations. In some embodiments, the height of the outer shell may be relatively small as compared to the heat of the tab. For example, the previously described ratios of height Ho of the outer shell to the height Ht of tab may have a lower limit of 1:10 (height Ho:height Ht).

As best shown in FIG. 3, the inner cap 106 may be at least partially located within the lumen 104L of the outer shell 104. The inner cap 106 can extend from a proximal end 106*p* to a distal end 106*d* and may have a substantially cylindrical shape. As referenced previously, the proximal end 106*p* of the inner cap 106 can be located within the lumen 104L of the outer shell 104. The inner cap 106 has a distal end 106*d* that may extend distally beyond the distal end 104*d* of the outer shell 104. The inner cap 106 securely couples the cap 100 with the straw 102. For example, an inner surface 106*i* of the inner cap 106 may include threads 105 configured to engage counterpart threads (not shown) on the straw 102. Alternative secure connection mechanisms between the inner cap 106 and the straw 102 also fall within the scope of the present disclosure.

Figure 5:
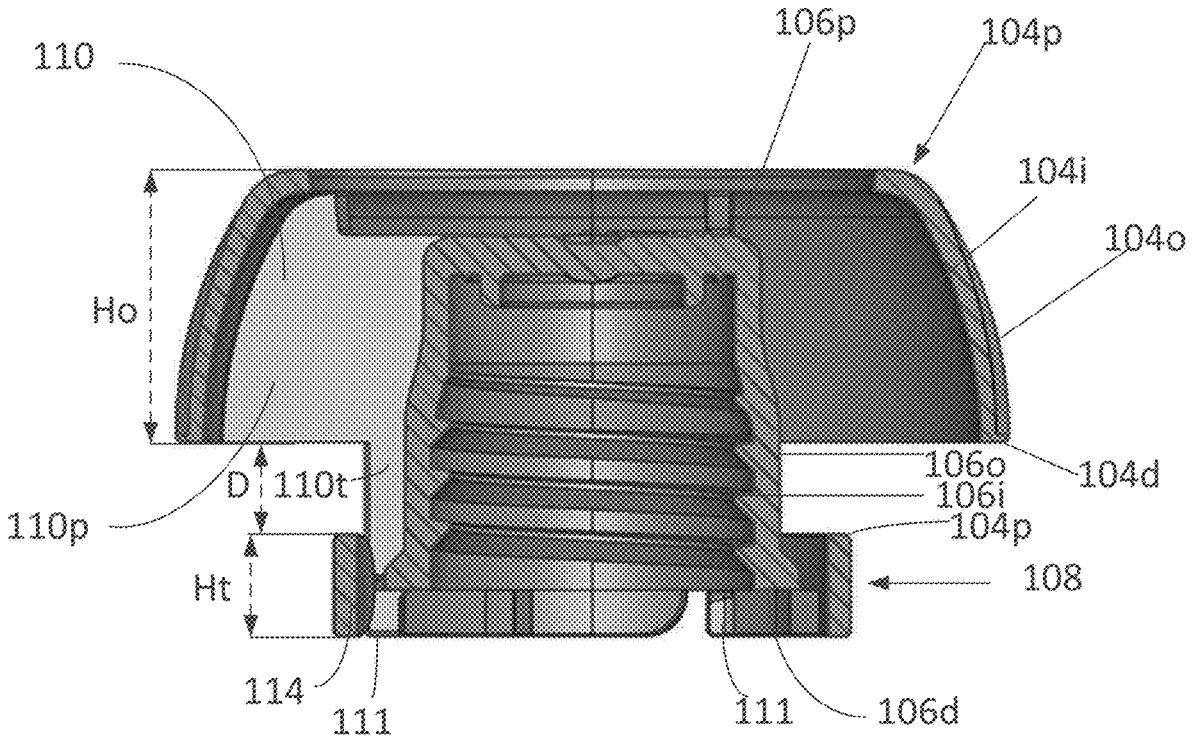
FIG. 5 is a cross-sectional view of the closure of FIG. 1 taken along the line A-A of FIG. 1.
Figure 6A:
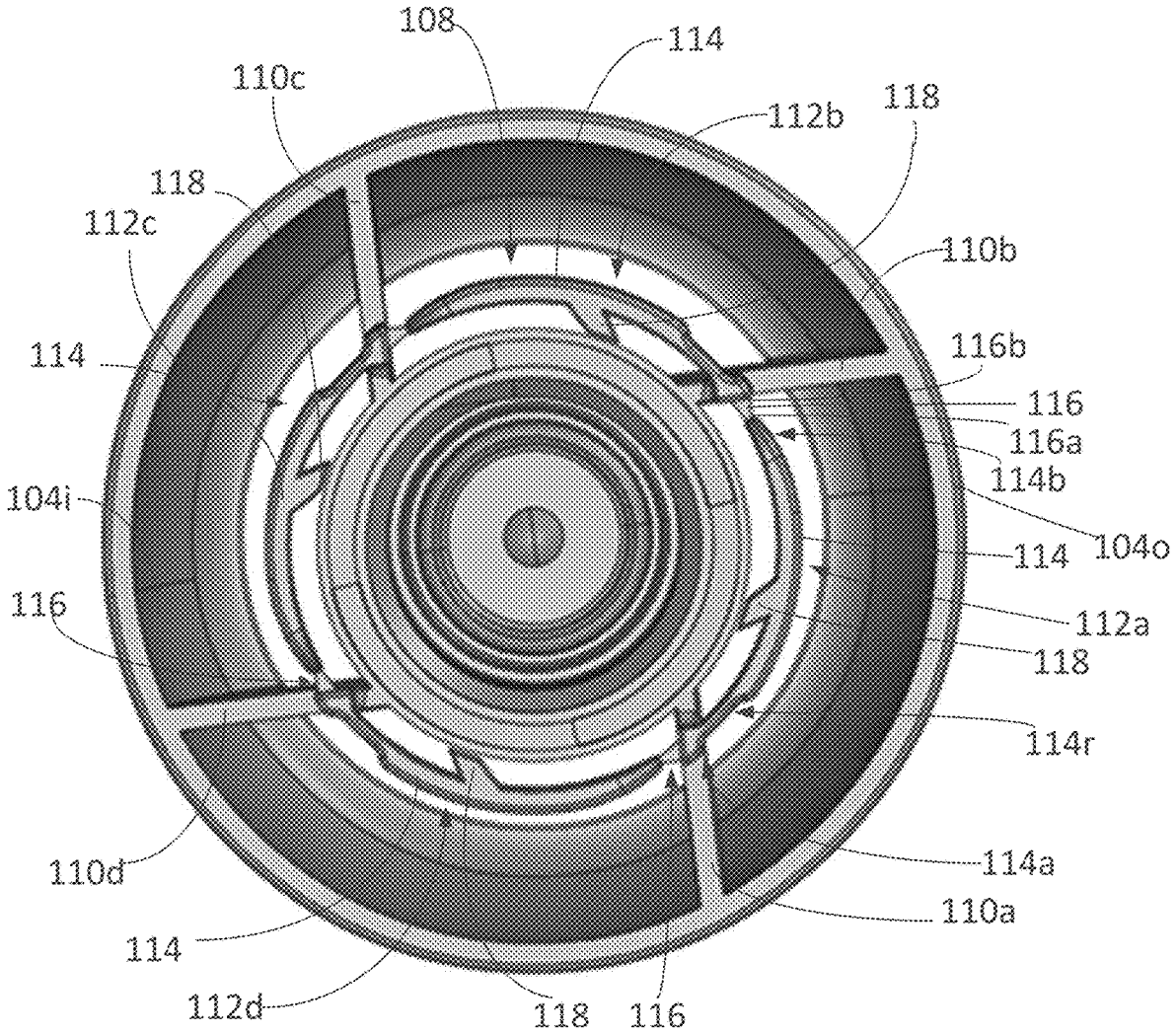
FIG. 6A is a bottom-up view of the closure of FIG. 1 in a sealed configuration.
Figure 6B:
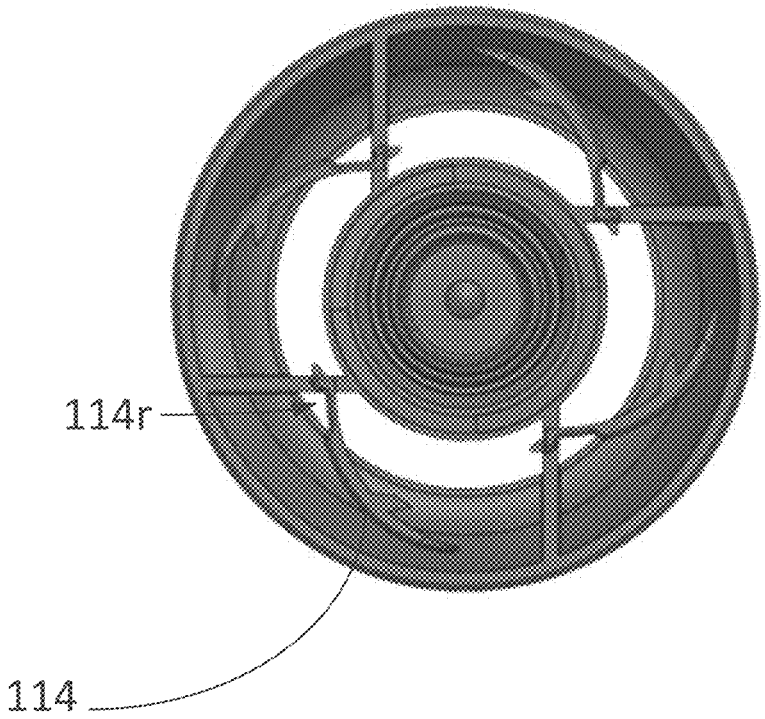
FIG. 6B is a bottom-up view of FIG. 6A with the tabs in an open configuration.

One or more ribs 110 extend between the inner cap 106 and the outer shell 104. Each rib 110 can be rigid and can extend vertically along the proximal-distal axis A1. As best shown in FIGS. 3 and 5, the ribs 110 may have a proximal portion 110*p* that couples with the outer shell 104. The ribs 110 may also have a distal or terminal portion 110*t* coupled with the tab 114 and/or break segment 116. While the illustrated embodiment of the cap 100 includes four ribs 110*a*, 110*b*, 110*c*, 110*d*, collectively referred to as ribs 110, one skilled in the art understands that caps 100 of the present disclosure may have a greater or fewer number of ribs. The one or more ribs 110 can extend radially outward from an outer surface 106*o* of the inner cap 106 to an inner surface 104*i* of the outer shell 104. In some embodiments, each rib 110 can extend along the inner surface 104*i* of the outer shell 104 from the proximal end 104*p* to the distal end 104*d* of the outer shell.

Figure 7A:
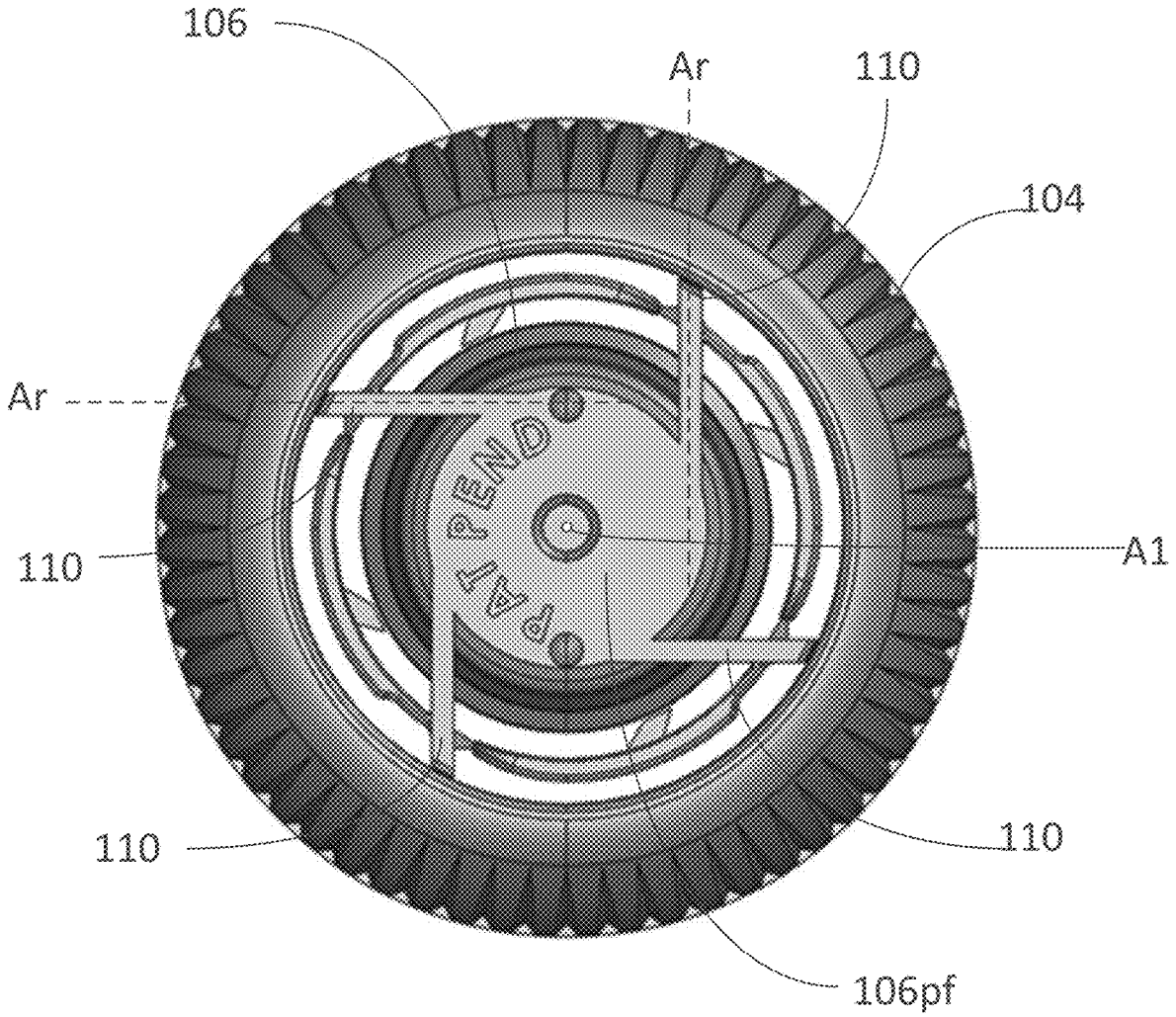
FIG. 7A is a top-down view of the closure of FIG. 1 in a sealed configuration.
Figure 7B:
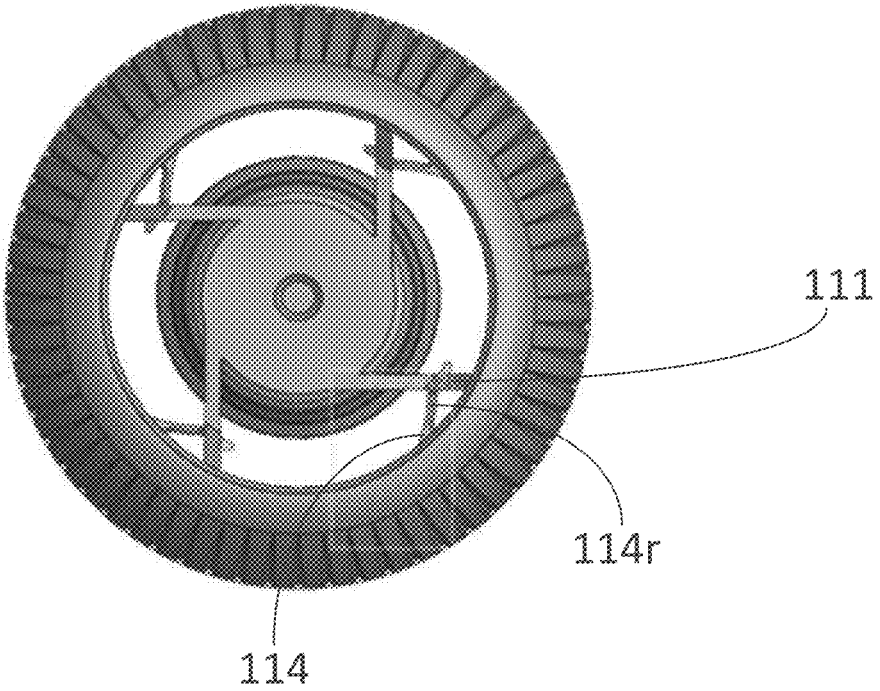
FIG. 7B is a top-down view of FIG. 7A with the tabs in an open configuration.

As can best be seen from the top-down view of FIG. 7A, a proximal facing surface 106*pf* of the inner cap 106 may have a circular shape. Each of the ribs 110 extends between the outer shell 104 and the inner cap 106. The ribs 110 may extend substantially at a tangent to the proximal facing surface 106*pf* of the inner cap 106. Although shown extending at a tangent, the ribs may also extend radially outward from the proximal facing surface 106*pf* (e.g., in a cross-like orientation), or in any other suitable orientation. As shown in the figure, the ribs 110 may extend in the proximal direction beyond the proximal facing surface 106*pf*. Regardless of the shape of the proximal facing surface 106*pf*, the ribs 110 may be offset from the central longitudinal axis A1 (e.g., an axis Ar of the rib 110 does not intersect with the central longitudinal axis A1 of the cap 100). In other words, the ribs 110 may be substantially parallel to a plane including the central longitudinal axis A1. This contrasts with some other embodiments, where the rib axis Ar may with a plane that includes the central longitudinal axis A1.

Longitudinally, as best shown in FIG. 5, each rib 110 can extend from the proximal end 106*p* to the distal end 106*d* of the inner cap 106. In some embodiments, the distal end 111*a*, 111*b*, 111*c*, 111*d* of each rib 110*a*, 110*b*, 110*c*, 110*d* can extend distally beyond the distal end 106*d* of the inner cap 106.

Figure 4A:
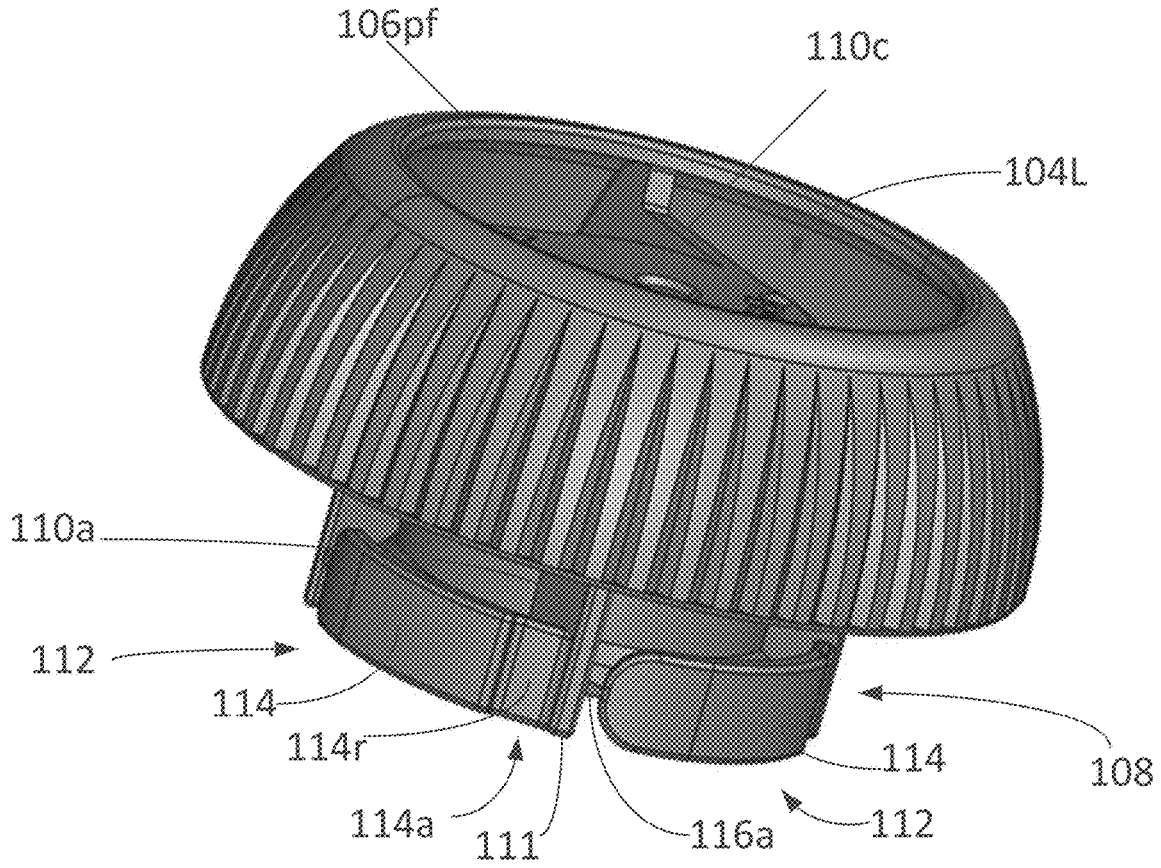
FIG. 4A is a perspective view of the closure of FIG. 1 in a sealed configuration.
Figure 4B:
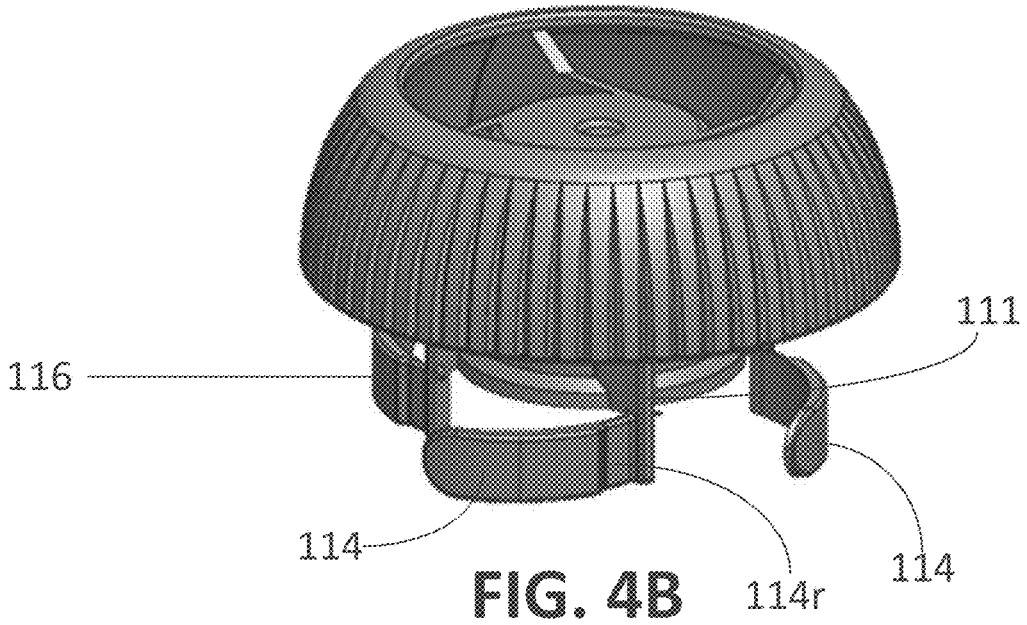
FIG. 4B is a perspective view of FIG. 4A with the tabs in an open configuration.

As best shown in FIG. 4A, the tamper-evident band 108 will now be described in greater detail. FIG. 4A shows the tabs in a closed or sealed configuration. This is prior to a user twisting the cap off of the straw. FIG. 4B is a perspective view of FIG. 4A with the tabs in an opened or unsealed configuration. This is after the cap has been twisted on the straw and displays evidence of tampering/opening to the user.

As noted above, the tamper-evident band 108 can include a plurality of tamper-evident segments 112. In the illustrated embodiments, the tamper-evident band 108 can include four tamper-evident segments 112*a*, 112*b*, 112*c*, 112*d* (see FIG. 6A), which may collectively be referred to as tamper-evident segments 112 herein. Each tamper-evident segment 112 has the tab 114 and the break segment 116. The tamper-evident band 108 may include a different number of tamper-evident segments 112, such as one, two, three, five, etc., without departing from the spirit of the present disclosure. The tamper-evident segments 112 may be separated by the ribs 110.

Figure 12:
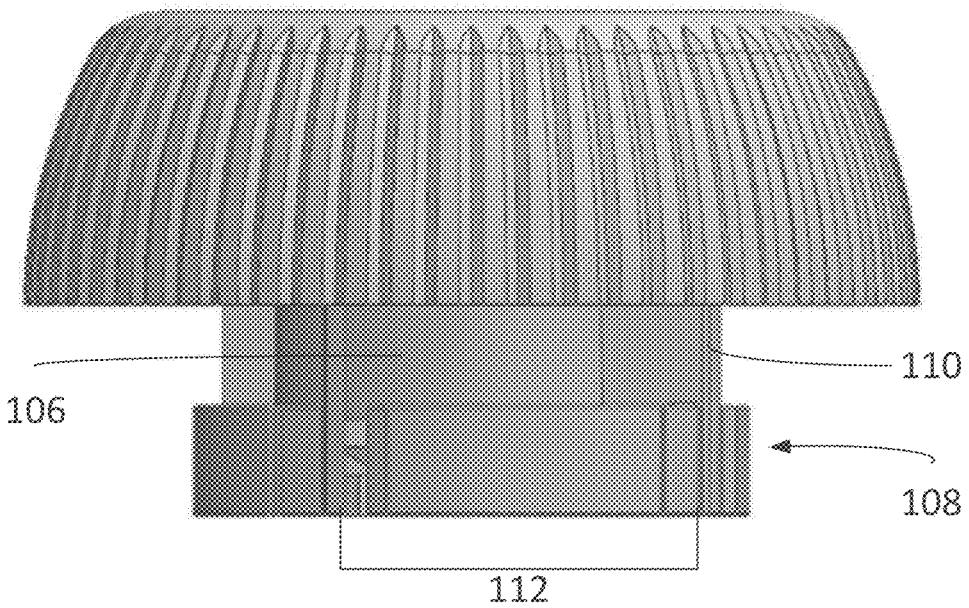
FIG. 12 is a front view of the closure of FIG. 11.
Figure 13:
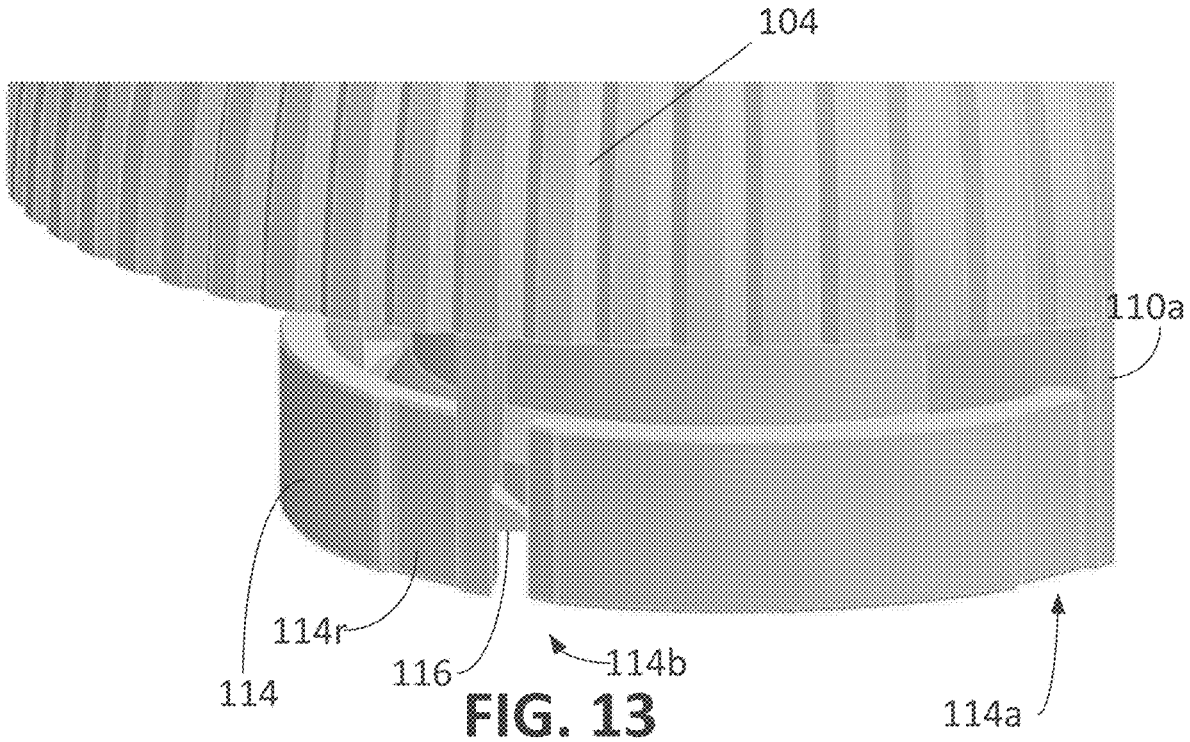
FIG. 13 is a detailed view of a tamper-evident band of the closure of FIG. 11.
Figure 14:
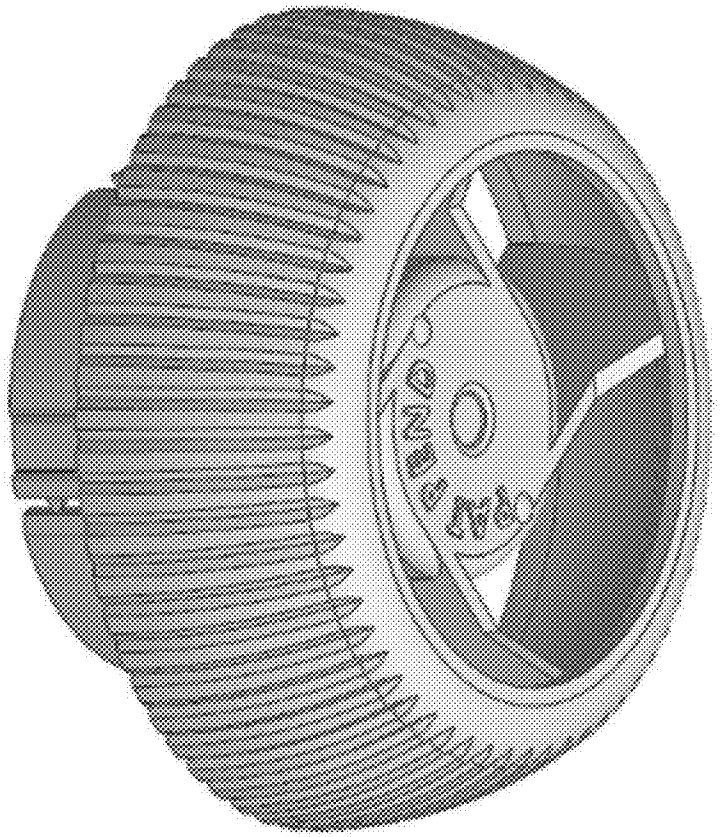
FIG. 14 is a perspective view of the closure of FIG. 11.

The tamper-evident segments 112 may be separated by the ribs 110. For example, and with reference to FIG. 6A, a first tamper-evident segment 112*a* can extend between a first rib 110*a* and an adjacent second rib 110*b*. More particularly a first end 114*a* of the tab 114 of the first tamper-evident segment 112*a* can be coupled to the first rib 110*a*. A second end 114*b* of the tab 114 of can be coupled with a first end 116*a* of the break segment 116. A second end 116*b* of the break segment 116 can be coupled to the second rib 110*b*. The tab 114 may have a length that extends along a curve. In some embodiments, the curve may be concentric with a circumference formed by the inner cap 106. Along its length, the tab 114 can have a substantially rectangular body extending longitudinally along the curve (e.g., as shown in FIG. 12). The thickness of the tab 114 may be substantially consistent throughout the length of the tab 114 (e.g., have a substantially uniform cross-section along its length), leading to a recessed portion that forms a hinge, Additionally, or alternatively, the thickness of the tab 114 may be tapered, or include a tapered portion, to form the hinge (e.g., a cross-section that gets smaller in at least one dimension along its length). In some embodiments, the second end 114*b* of the tab 114 can have an arcuate or semi-circular shape. As illustrated in FIGS. 1-10, the connection between the break segment 116 and the second end 114*b* of the tab 114 can occur at a mid-point of the second end 114*b*, as measured along a proximal-distal axis A1. In other embodiments, the connection between the break segment 116 and the second end 114*b* of the tab 114 can occur more proximally or distally with respect to the proximal-distal axis A1.

Figure 8:
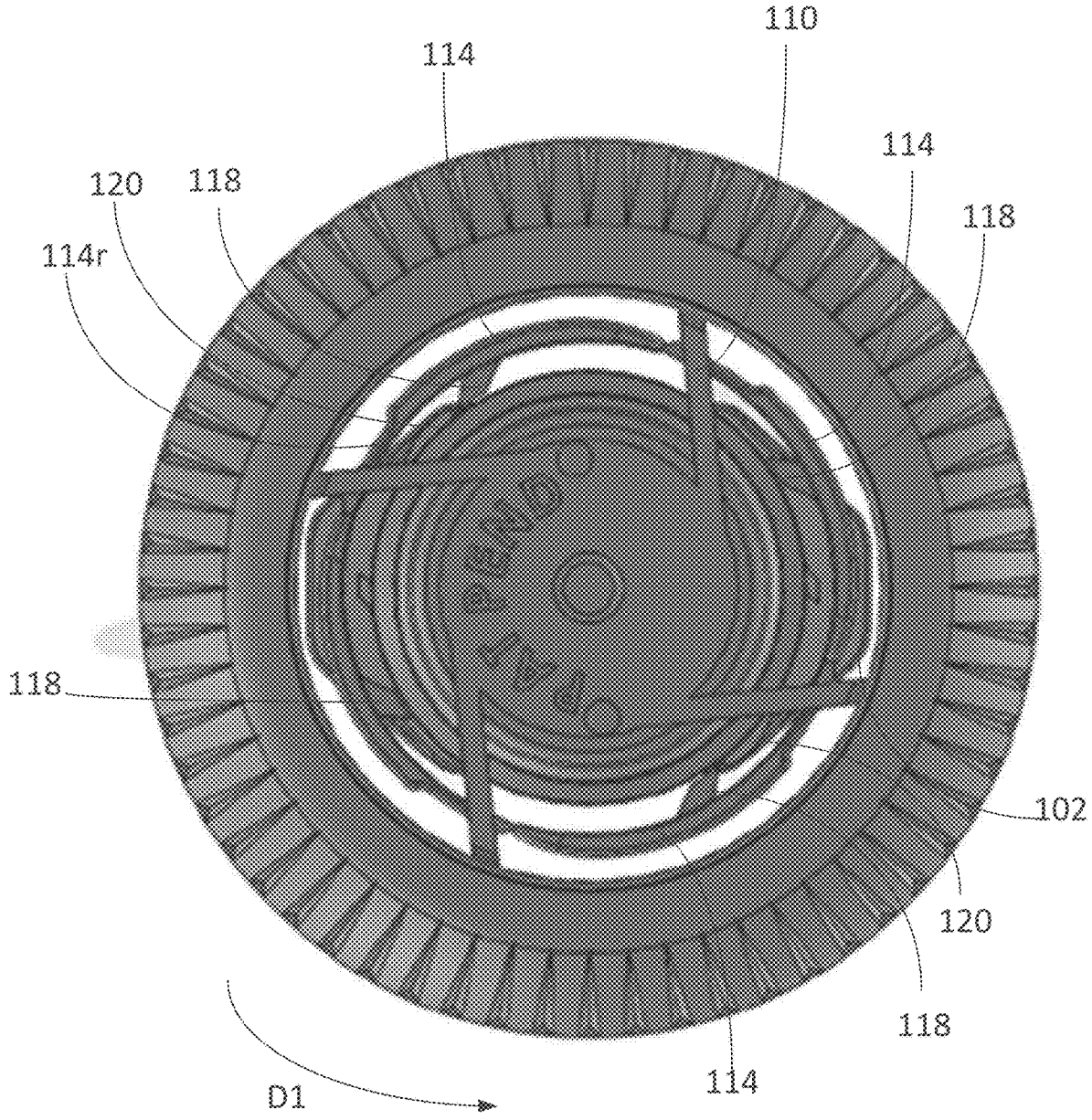
FIG. 8 is a top-down view of the closure and straw of FIG. 1.

FIG. 8 shows a top-down view of the cap 100 coupled with the straw 102. A lug 118 can extend inwardly (e.g., radially inward) from the tab 114 towards the inner cap 106. The lug 118 can abut or otherwise contact a counterpart cam 120 of the straw 102. Upon relative rotation between the cap 100 and the straw 102, the lug 118 interferes with the cam 120, which prevents rotation between the cap 100 and the straw 102. By providing sufficient rotational force caused by rotation of the outer shell 104, e.g., in the direction of arrow D1 shown in FIG. 8, relative to the straw 102, the interference between lug 118 and cam 120 is overcome. The lug 118 is deflected upwardly and/or outwardly because of contact with the cam 120, which causes the tab 114 to separate or break away from the break segment 116 and pivot about the rib 110 at the first end 114*a* of the tab 114 (e.g., about a hinge 114*r*). With the pivoting of the tab 114, the tab 114 is visibly repositioned or deformed from its initial or resting state (e.g., as shown in FIGS. 1-10), which can indicate to a user that the cap 100 has been tampered with. For example, the second end 114*b* of tab 114 can move outwards or away from the inner cap 106 such that the tab 114 no longer lies along a uniform circumference with the remaining tamper-evident segments. The tab 114 may include a hinge 114*r* (e.g., a recessed portion configured to flex, a tapered portion, etc.) that pivots the tab 114 about the rib 110. In some embodiments, the tab 114 can be integrally formed with the rib 110 to which the first end 114*a* of the tab is coupled. In other embodiments, the tab 114 can be separately formed from the rib 110 with the first end 114*a* of the tab securely coupled to the rib 110 to allow pivoting of the tab 114 about the rib 110 while maintaining a full connection therebetween.

In various embodiments, the break tabs 116 are configured to have a threshold force applied by outward and/or upward movement of the lug 118 on the cam 120. Preferably, the threshold force is sufficient to withstand accidental breakage as a result of rotational forces that may occur during normal handling of the cap 100. Some embodiments may use a single cam 120, such that a single break segment 116 breaks at a time (e.g., and a single tab 114 pivots around hinge 114*r*). Additionally, or alternatively, some embodiments may have multiple cams 120. For example, a corresponding cam 120 may be positioned for each tab 114, such that all the break segments 116 break substantially simultaneously.

Figure 9A:
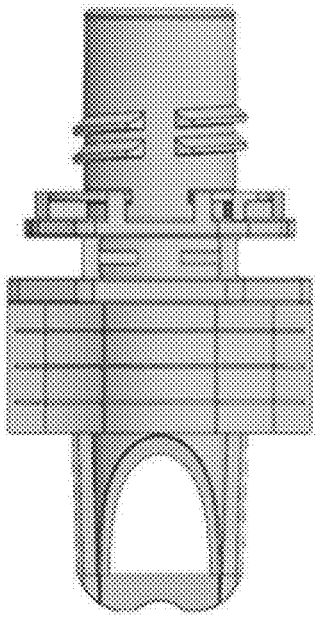
FIGS. 9A-9F are various views of the straw of FIG. 1.
Figure 9B:
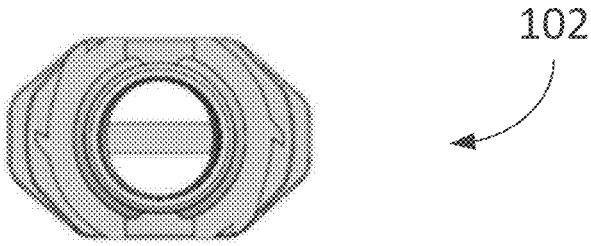
Figure 9C:
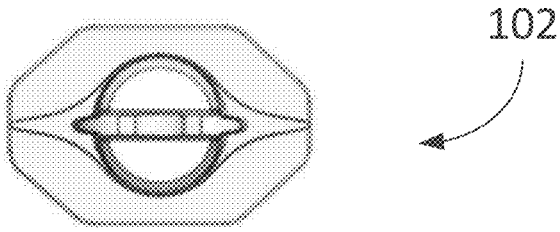
Figure 9D:
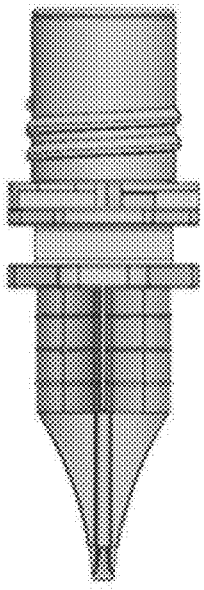
Figure 9E:
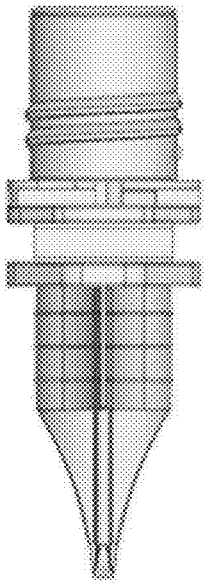
Figure 9F:
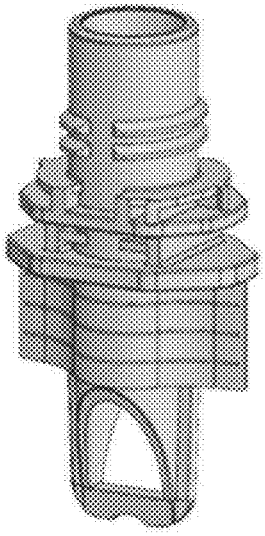

FIGS. 9A-9F are various views of the straw 102 of FIG. 1. Specifically, FIG. 9A shows a front view of the straw 102; FIG. 9B shows a top view of the straw 102; FIG. 9C shows a bottom view of the straw 102; FIG. 9D shows a left side view of the straw 102; FIG. 9E shows a right side view of the straw 102; and FIG. 9F shows a perspective view of the straw 102.

Figure 10A:
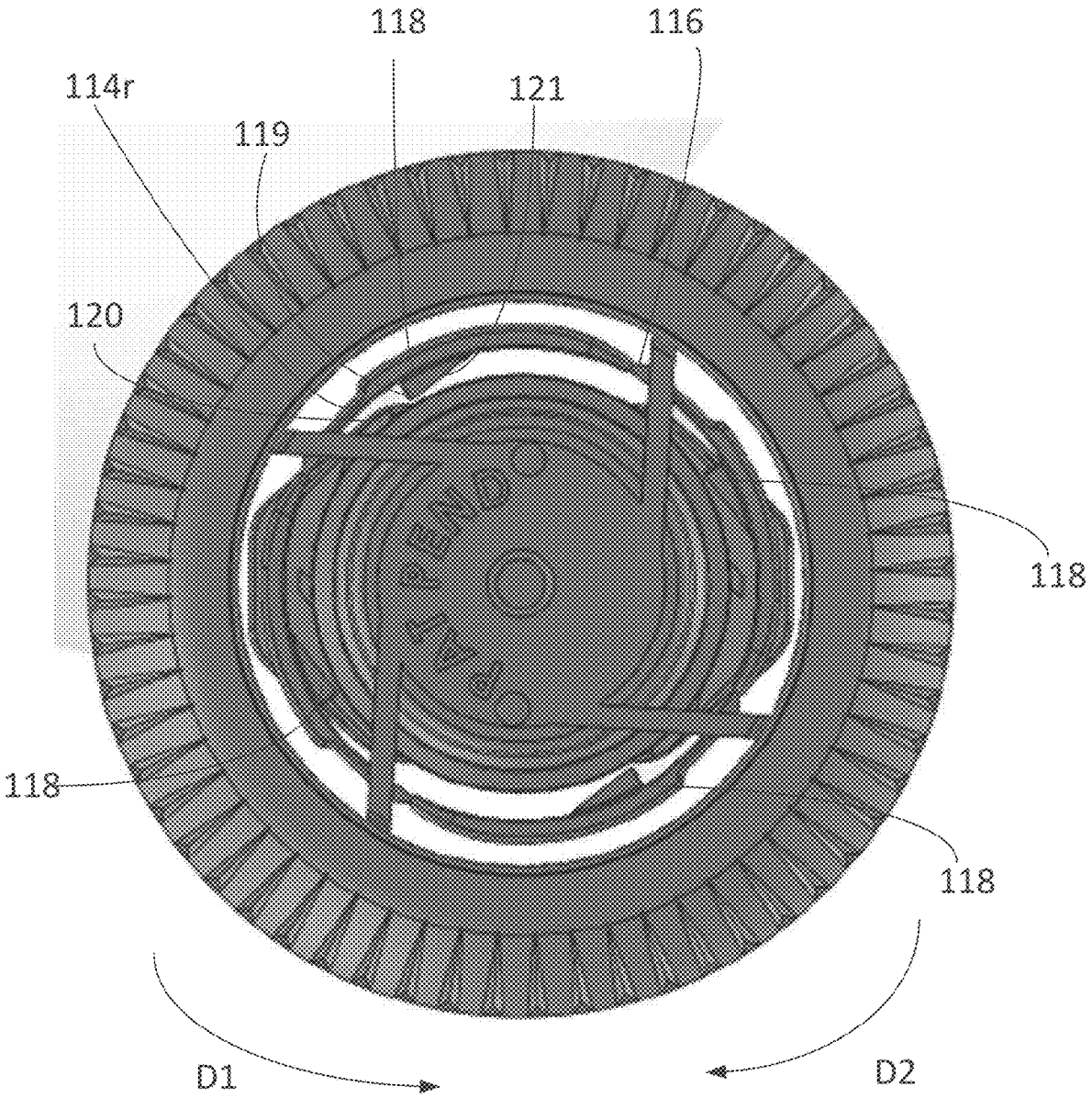
FIG. 10A is a top-down view of another embodiment of the closure of FIG. 1 with alternative lug construction coupled to a straw.
Figure 10B:
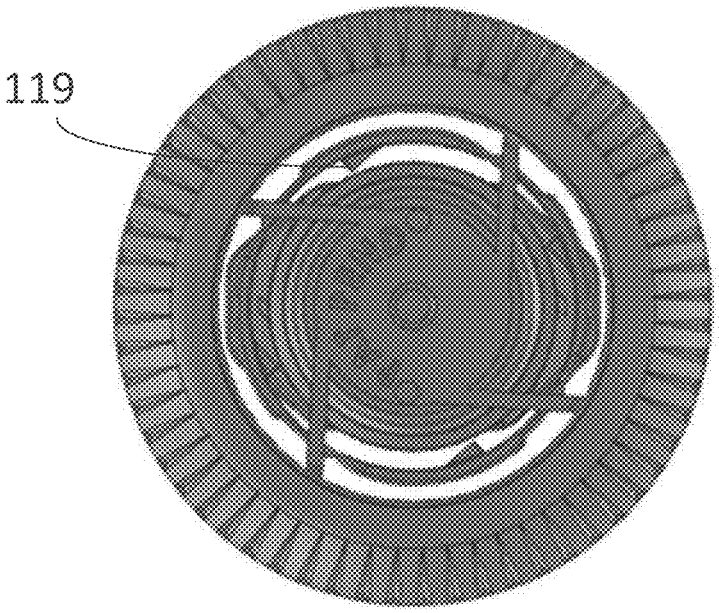
FIG. 10B is a top-down view of another embodiment of the closure of FIG. 1 with alternative lug construction.
Figure 11:
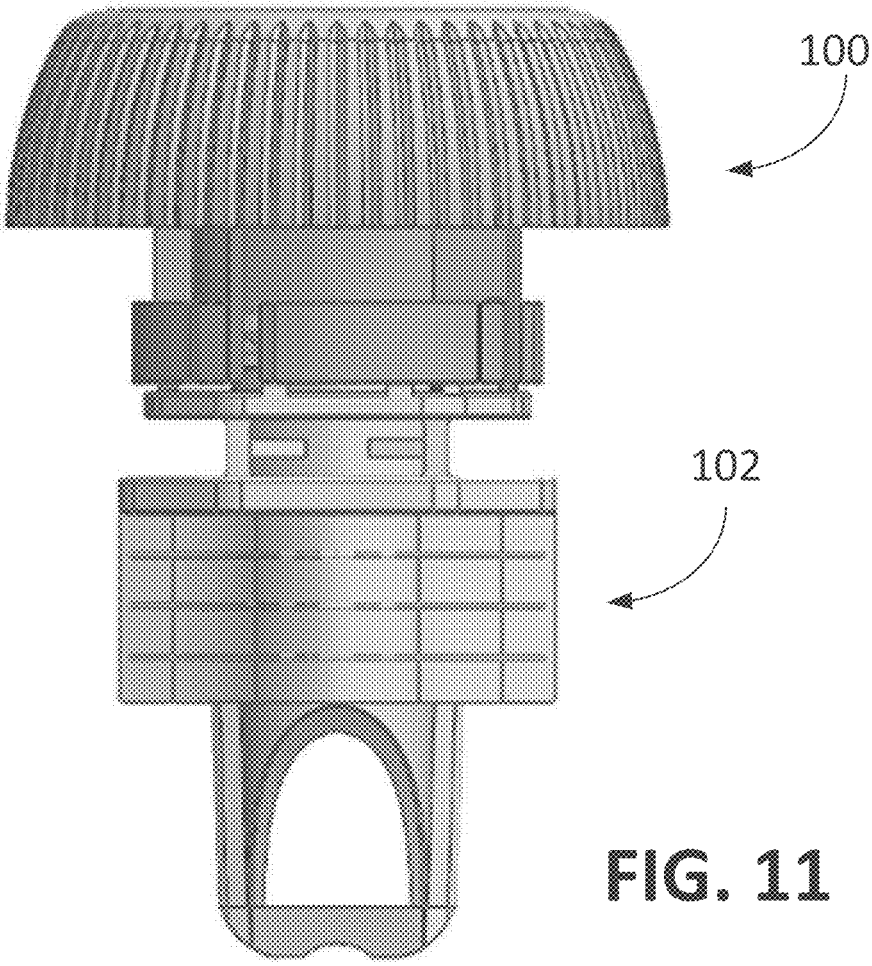
FIG. 11 is a front view of another embodiment of a closure in accordance with the present disclosure coupled to a straw.

FIGS. 10A and 10B illustrate alternative constructions of the lug 118 and the cam 120 in accordance with the present disclosure. While the construction of the lugs 118 and cams 120 may vary from that illustrated in FIGS. 1-8, the function and operation of the lugs 118 and cams 120 can remain the same or substantially the same. Accordingly, a detailed description of the function and operation of the lugs 118 and cams 120 is omitted for the sake of brevity.

FIG. 10A shows the lug 118 formed as a ramp on an inner surface of the tab 116 in accordance with illustrative embodiments. The lug 118 also has a radially inwardly projecting surface 119. In various embodiments, the inwardly projecting surface 119 allows single direction opening of the device. In some embodiments, the cap 100 and the straw 102 are configured such that the inwardly projecting surface 119 is also a lug-interfering surface. When the cap 100 is rotated in a first direction D1 (e.g., counter-clockwise) the lug-interfering surface 119 interferes with the lug 118. Upon the application of a sufficient threshold force in the direction D1, the break segment 116 is configured to break prior to any other part of the cap 100. After the break segment 116 breaks, the hinge 114*r* flexes and moves (e.g., swings) the tab 114 outwardly to show that the cap 100 has been opened. The cap 100 and the straw 102 may be configured so that the ramped surface 121 is not able to slide over the lug 118, thereby preventing full rotation in direction D2.

Although the examples discussed herein describe rotation in a first direction D1 that is counter-clockwise to break the seal and open the cap 100, this is merely for the sake of discussion. In general, the industry standard is to open caps 100 in a counter-clockwise direction D1. However, it should be apparent to one of skill in the art that the straw 102 and the cap 100 may be reconfigured so that the same principles described herein operate to break the seal and open the cap 100 in a clockwise direction.

In some alternative embodiments, the cap 100 and the straw 102 may be configured so that when the cap 100 is rotated in a first direction D1 (e.g., counter-clockwise), the radially inward surface 119 interferes with the cam 120, and the cap 100 can no longer be rotated relative to the straw 102. However, when the cap 100 is rotated in a second direction D2 (e.g., clockwise), the ramped surface 121 travels along the cam 120 until the threshold force is reached and the break segment 116 breaks. As described previously, the hinge 114*r* may cause the tab 114 to swing outwardly.

FIG. 10B shows the lug 118 formed as a triangular projection in accordance with illustrative embodiments. In a manner similar to FIG. 10A, the lug 118 has the ramped surface 121. However, instead of the radially inward surface 119, the lug 118 may have a substantially radially inwardly projecting surface 119. The inwardly projecting surface 119 may have a variety of angles relative to radially inward that may be used to interfere with the lug 118 and cause the break segment 116 to break.

FIGS. 11-17 illustrate another embodiment of the cap 100 in accordance with the present disclosure. Except as described in detail below, the cap 100 can be similar or substantially similar to the cap 100 described with respect to FIGS. 1-10. Accordingly, description of the cap's 100 structure, operation, and use is omitted herein for the sake of brevity. The cap 100 can coupled to a straw 102 of a container (shown in FIG. 11). As described previously, the tamper-evident band 108 can include a plurality of tamper-evident segments 112, with each tamper-evident segment 112 including the tab 114 and the break segment 116. The tab 114 of the cap 100 can have an alternative configuration as compared to the tabs 114 described above. More particularly, the tab 114 can have a substantially rectangular surface area. A first end 114*a* can be coupled to a first rib 110*a* and the second end 114*b* of the tab 114 can be coupled to the break segment 116. The second end 114*b* of the tab 114 can have a linear edge to which the break segment 116 is connected.

Although illustrative embodiments show the hinge 114*r* of any given tab 114 positioned counter-clockwise relative to the break segment 116 (e.g., from a top view shown in FIG. 10A), the positions of the hinge 114*r* and the tab 114 may be swapped in various embodiments. Thus, the break segment 116 may be positioned counter-clockwise relative to the hinge 114*r* for a given tamper evident segment 112. Put another way, in various embodiments, the hinge 114*r* may be positioned at the second end 114*b* and the break segment may be positioned at the first end 114*a* of the tab 114, or vice-versa. The inventors believe that, in some embodiments, positioning the break segment 116 counter-clockwise relative to the corresponding hinge 114*r* improve the reliability of the tab 114 swinging outwardly.

Figure 15:
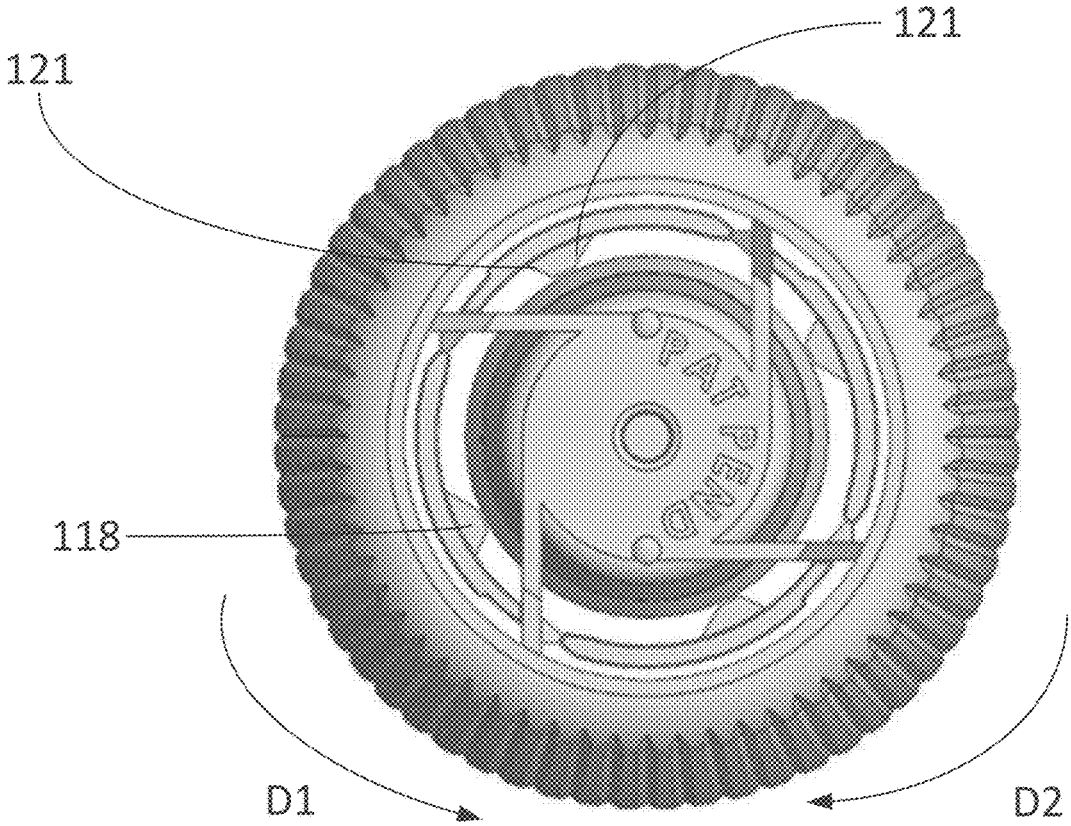
FIG. 15 is a top-down view of the closure of FIG. 11.
Figure 16:
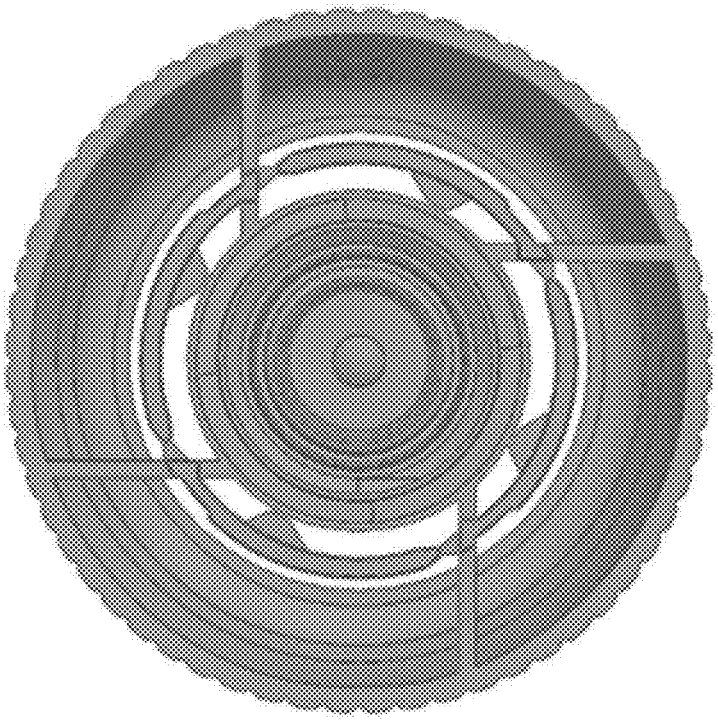
FIG. 16 is a bottom-up view of the closure of FIG. 11.
Figure 17:
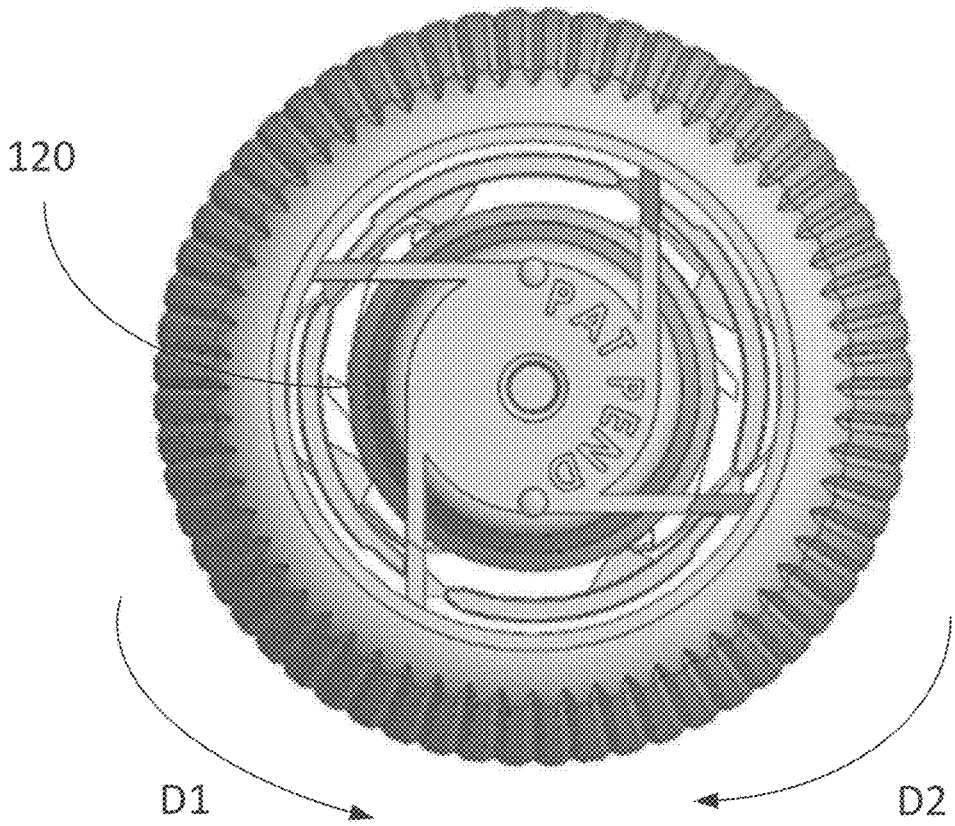
FIG. 17 is a top-down view of the closure of FIG. 11.
Figure 18:
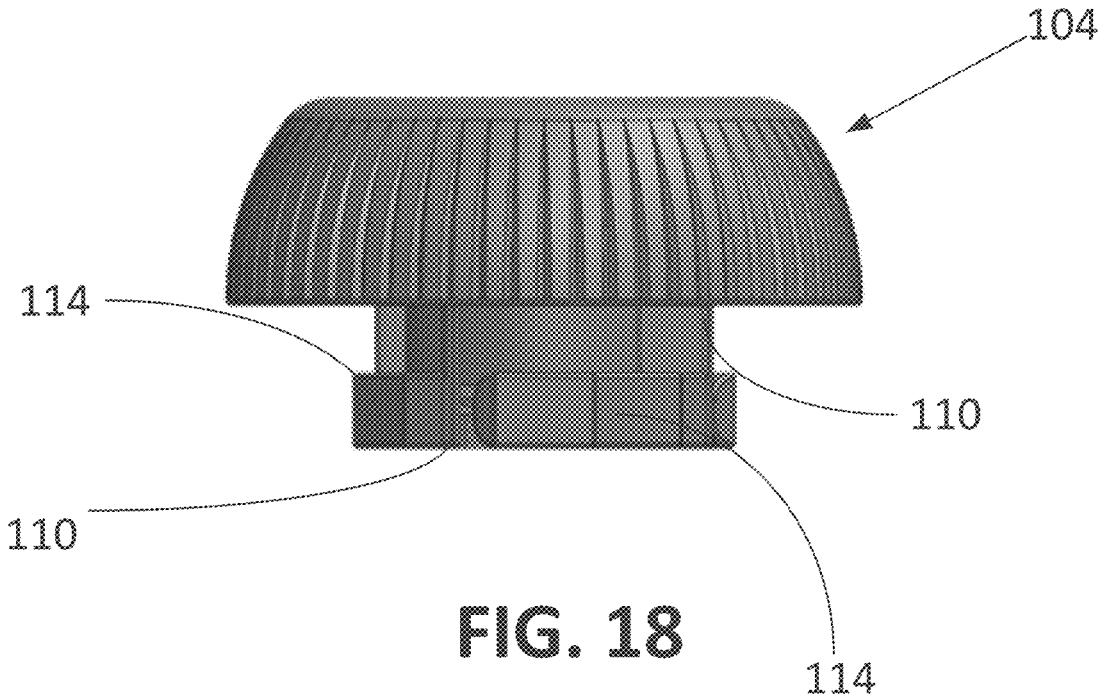
FIG. 18 is a front view of another closure of the present disclosure.
Figure 19:
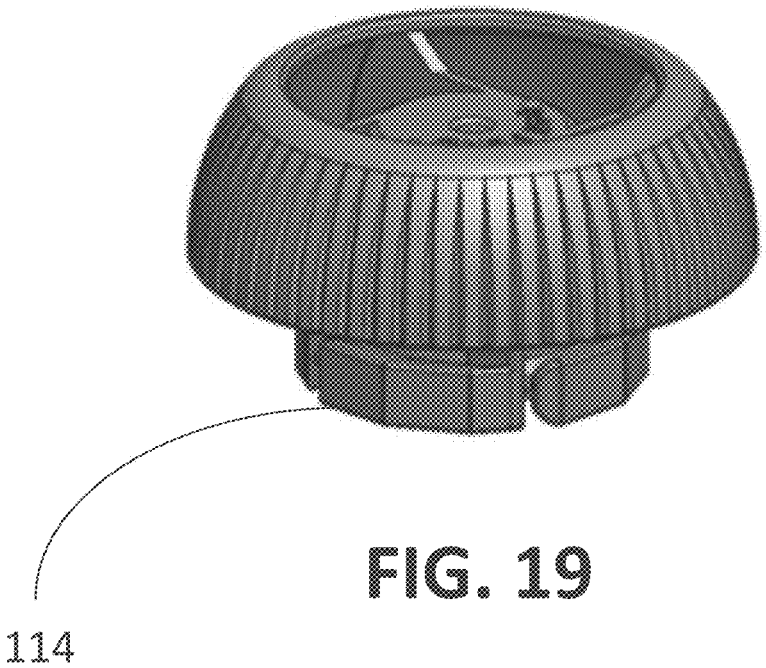
FIG. 19 is a perspective view of the closure of FIG. 18.
Figure 20A:
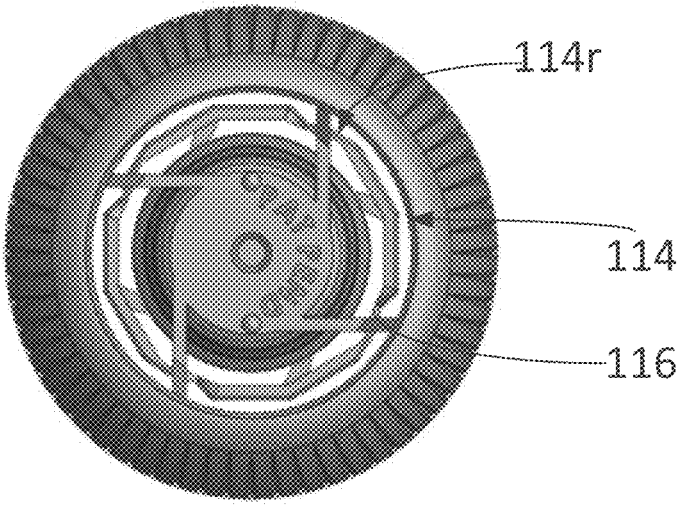
FIG. 20A is a top-down view of FIG. 18.
Figure 20B:
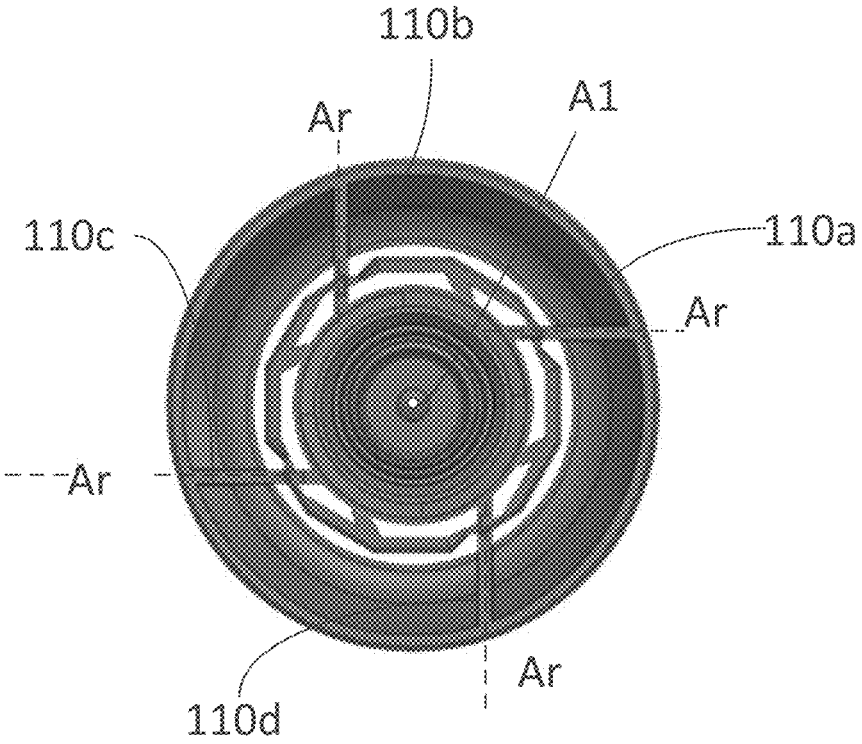
FIG. 20B is a bottom-up view of FIG. 18

As best shown in FIG. 15, the lug 118 may have two ramped surfaces 121. Accordingly, based upon the design of the corresponding cams 120, the tamper-evident cap 100 may be opened in either rotational direction. For example, FIG. 17 shows that the cam 120 blocks rotation of the cap in a counter-clockwise direction D1, but enables opening of the cap 100 in clockwise direction D2. FIG. 16 shows a bottom view of the cap 100. FIG. 17 shows a top-down view of the cap 100 coupled with the straw 102.

FIGS. 18-20B schematically show various views of an alternative of the cap 100 in accordance with illustrative embodiments of the invention. As shown, the tabs 114 may have faceted (as opposed to smooth or arcuate) outwardly facing surface. Similar to the other embodiments, the cap 100 has a plurality of ribs 110. Additionally, the ribs 110 are oriented substantially tangentially with respect to the inner cap 106. Although a tangential orientation provides improved robustness, other embodiments may include ribs that are oriented radially inwardly towards the center of the inner cap 106. In such embodiments, a rib axis Ar defined by the ribs intersects the central longitudinal axis A1 of the cap 100. Furthermore, the rib axes Ar may intersect (e.g., rib 110*a* and 110*b* axes Ar are coincident, and rib 110*c* and 110*d* axes Ar are coincident).

Figure 21:
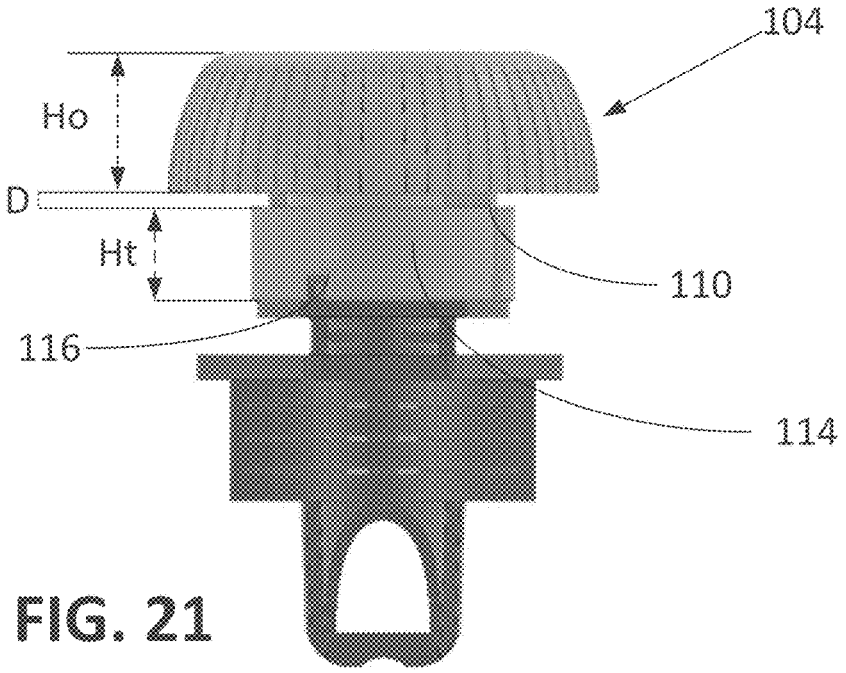
FIG. 21 is a front view of another closure of the present disclosure coupled to a straw.
Figure 22:
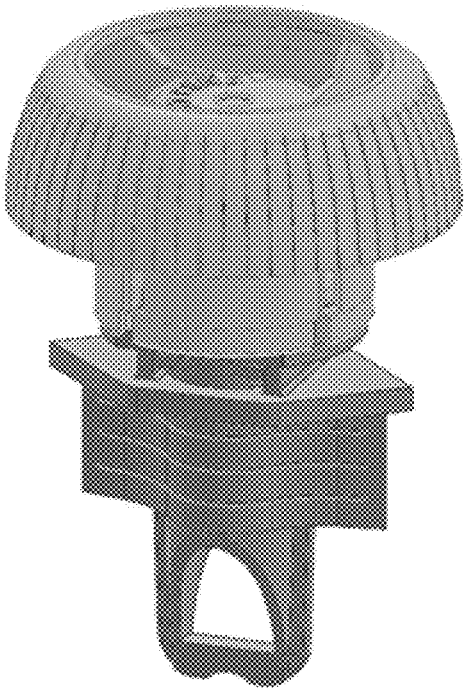
FIG. 22 is a perspective view of the closure of FIG. 21 coupled to the straw.
Figure 23:
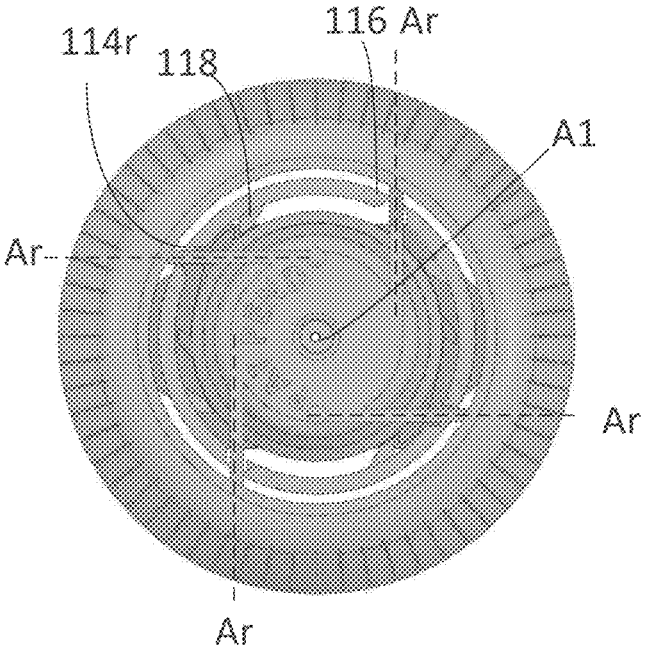
FIG. 23 is a top-down view of FIG. 21.

FIGS. 21-23 schematically show various views of an alternative of the cap 100 in accordance with illustrative embodiments of the invention. The tab 114 has a relatively large height Ht, such that there is substantially zero, or zero, distance D between the tab 114 and the outer shell 104 relative to the longitudinal axis (see FIG. 5 for comparison). The cap 100 has an internal hinge 114*r*. Specifically, the thinned portion of the tab 114 that forms the hinge 114*r* is internally facing, meaning the hinge 114*r* is not externally visible. In a manner similar to some other embodiments, the ribs 110 define axes Ar that intersect, but are not coincident. Furthermore, the rib axes Ar do not intersect the longitudinal axis A1 of the cap 100. The height Ht of the tabs 114 are relatively large (e.g., almost the same as the height Ho of the outer shell 104).

Figure 24:
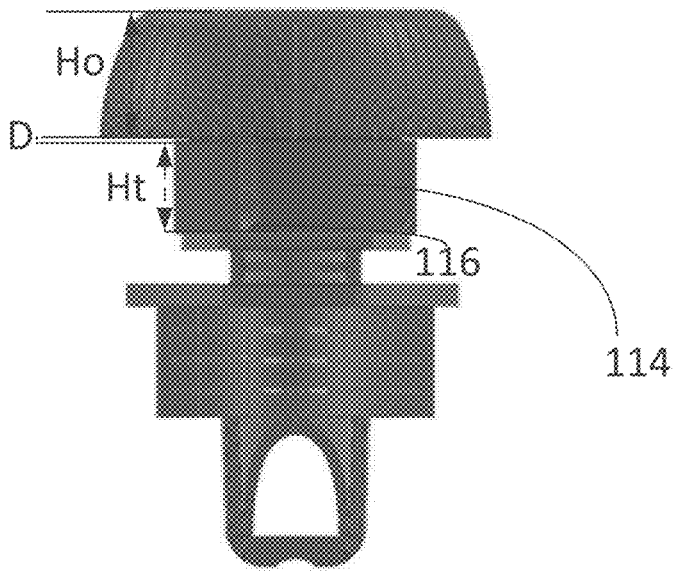
FIG. 24 is a front view of another closure of the present disclosure coupled to a straw.
Figure 25:
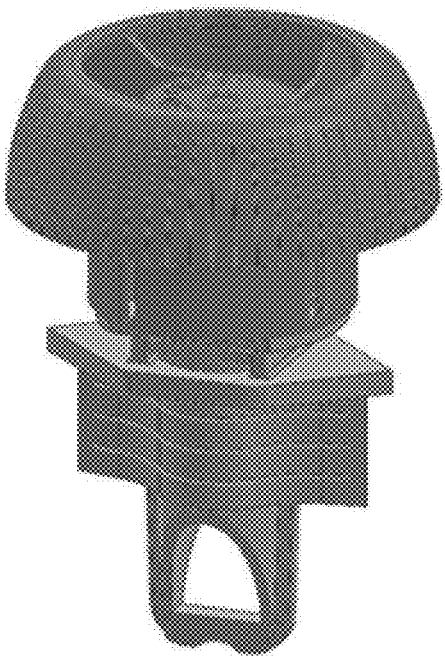
FIG. 25 is a perspective view of the closure of FIG. 24 coupled to the straw.
Figure 26:
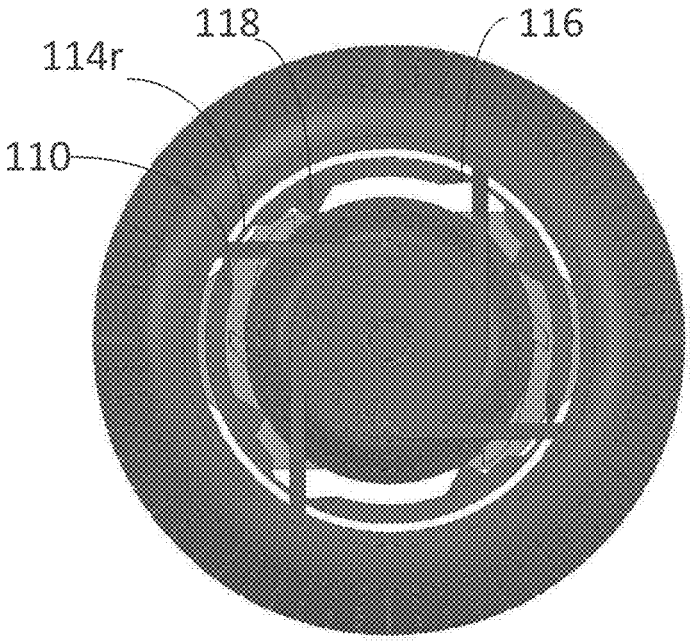
FIG. 26 is a top-down view of FIG. 24.

FIGS. 24-26 schematically show various views of an alternative of the cap 100 in accordance with illustrative embodiments of the invention. In a manner similar to the hinge 114*r* of FIGS. 21-23, the hinge 114*r* is internally recessed or tapered. However, the hinge 114*r* of FIGS. 24-26 additionally has a greater length as compared to the hinge 114*r* shown in FIGS. 21-23. The tab 114 is coupled with the break segment 116 towards a distal end.

Figure 27:
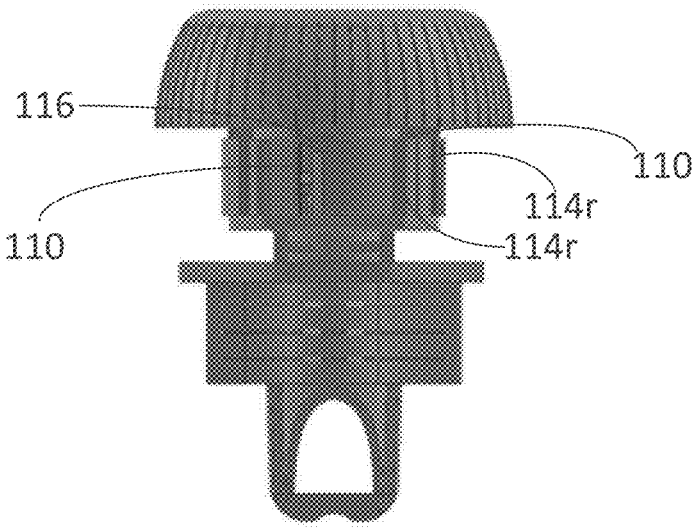
FIG. 27 is a front view of another closure of the present disclosure coupled to a straw.
Figure 28:
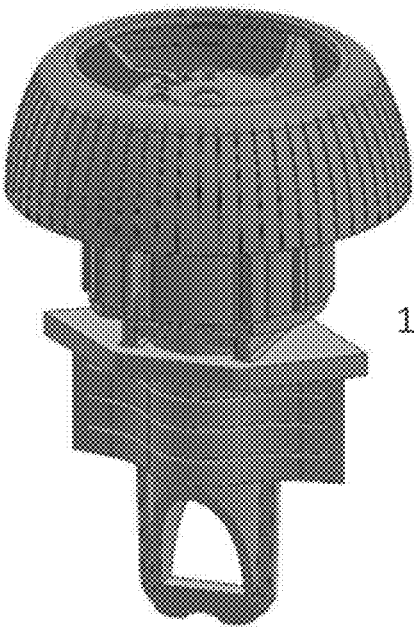
FIG. 28 is a perspective view of the closure of FIG. 27 coupled to the straw.
Figure 29:
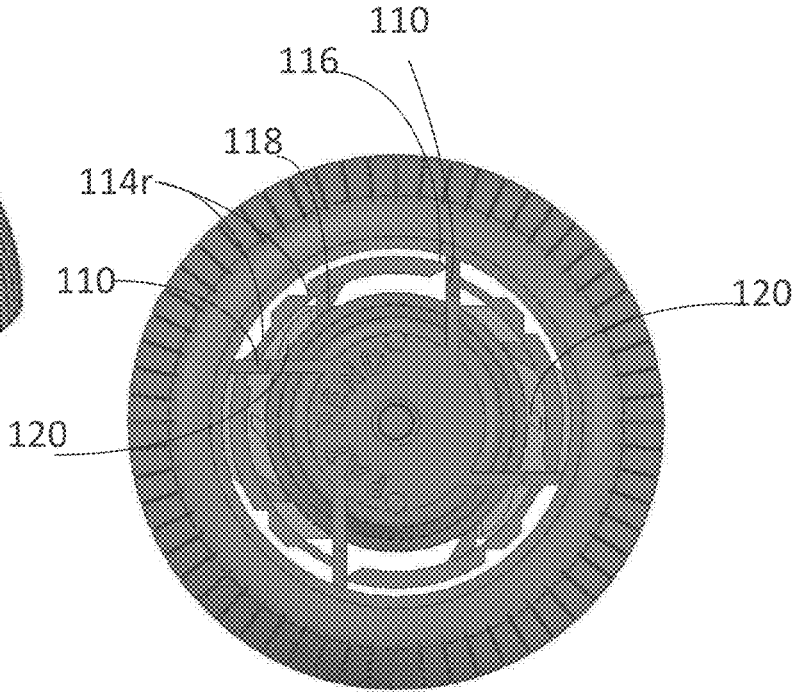
FIG. 29 is a top-down view of FIG. 27.

FIGS. 27-29 schematically show various views of an alternative of the cap 100 in accordance with illustrative embodiments of the invention. Illustrative embodiments may include a plurality of hinges 114*r* for each tamper-evident segment 112. The hinges 114*r* may be externally facing (as shown), or internally facing. Furthermore, the tab 114 may form the break segment 116.

Figure 30:
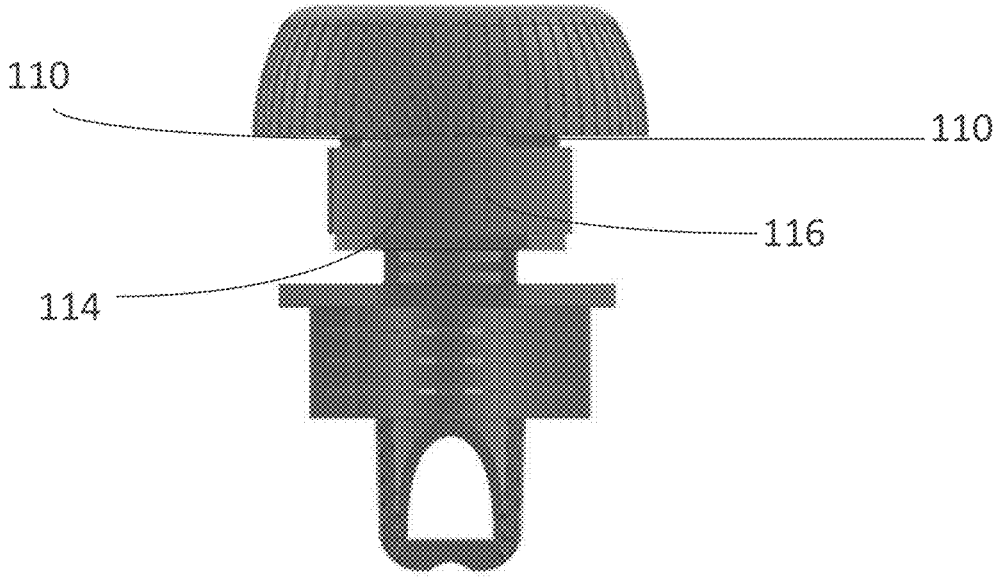
FIG. 30 is a front view of another closure of the present disclosure coupled to a straw.
Figure 31:
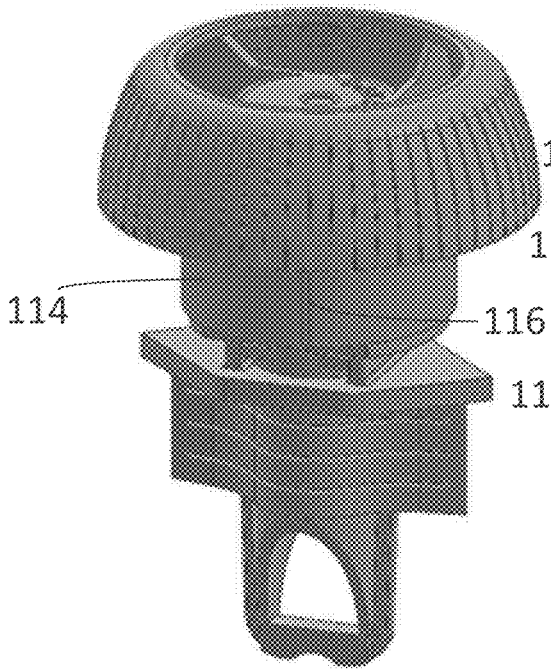
FIG. 31 is a perspective view of the closure of FIG. 30 coupled to the straw.
Figure 32:
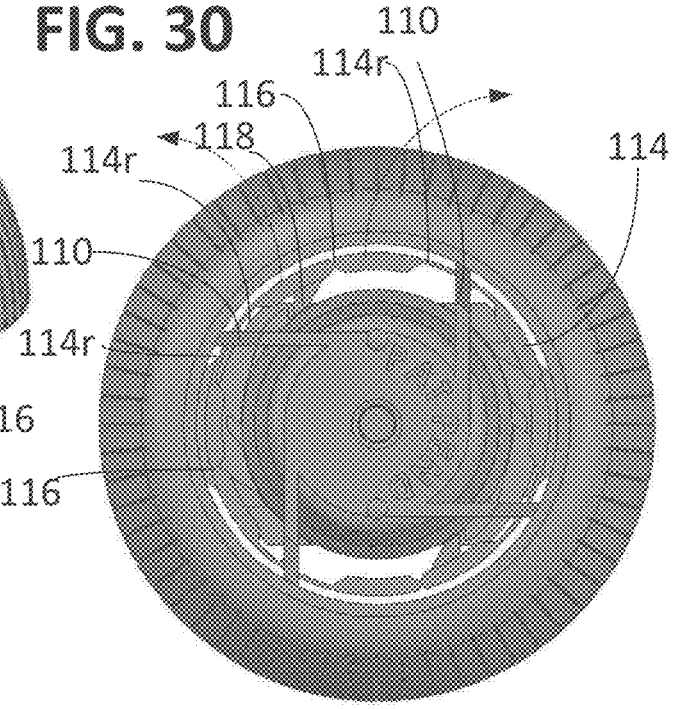
FIG. 32 is a top-down view of FIG. 30.

FIGS. 30-32 schematically show various views of an alternative of the cap 100 in accordance with illustrative embodiments of the invention. In a manner similar to the previously shown embodiment, each tamper-evident segment 112 may have a plurality of hinges 114*r*. As shown, each hinge 114*r* may be coupled to a respective rib 110. The break segment 116 may be formed as a tear strip 116 in the tab 114 itself. As shown in FIG. 32, the tear strip 116 may be substantially in the middle of the tamper-evident segment 112, such that the tabs 114 are configured to break open in up to two different directions (e.g., as shown by the two dotted arrows) to provide an easily identifiable tamper indication.

Figure 33:
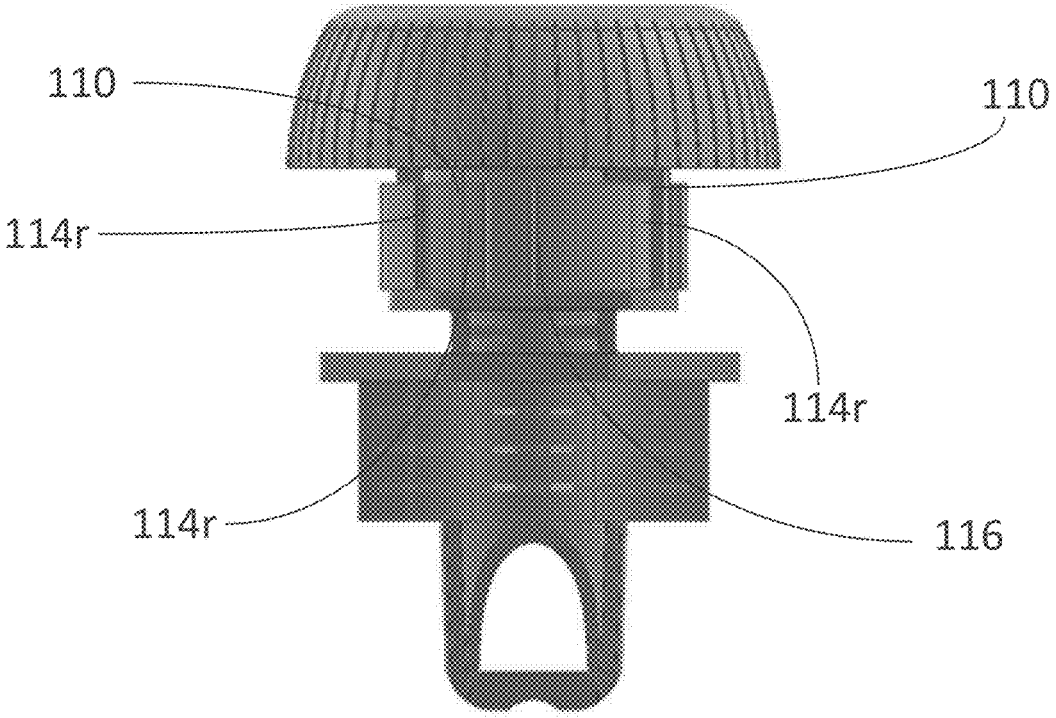
FIG. 33 is a front view of another closure of the present disclosure coupled to a straw.
Figure 34:
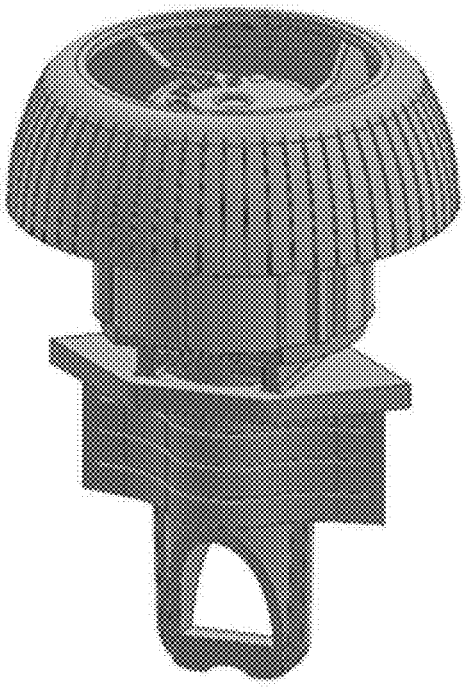
FIG. 34 is a perspective view of the closure of FIG. 33 coupled to the straw.
Figure 35:
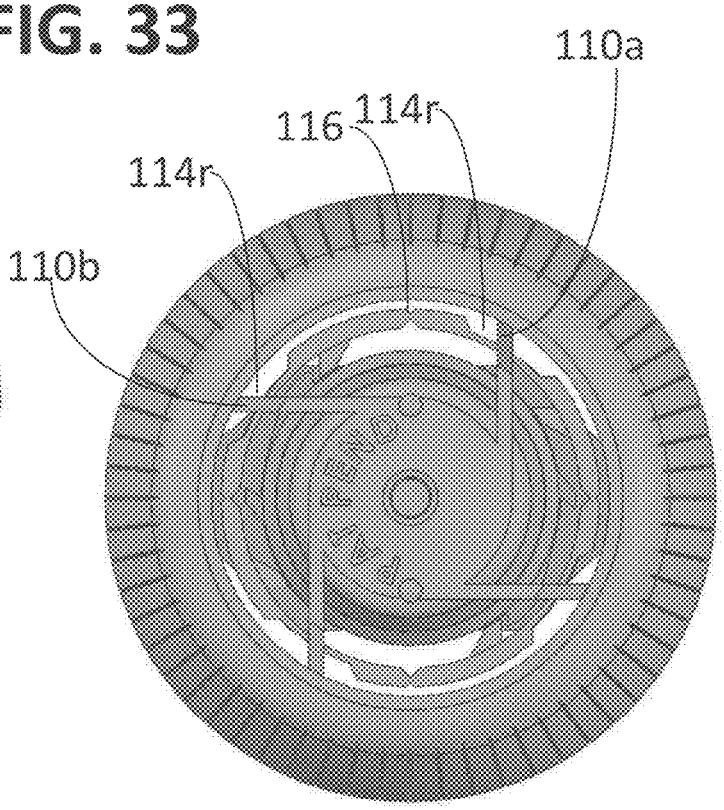
FIG. 35 is a top-down view of FIG. 33.

FIGS. 33-35 schematically show various views of an alternative of the cap 100 in accordance with illustrative embodiments of the invention. The break segment 116 may be formed as the tear strip 116 in the tab 114 itself. As shown, the tear strip 116 may be positioned so be positioned closer to a first rib 110*a* than a second rib 110*b*. This contrasts with other embodiments (e.g., shown in FIGS. 30-32), where the tear strip 116 is equidistant from the ribs 110*a* and 110*b* along a circumferential path.

Figure 36:
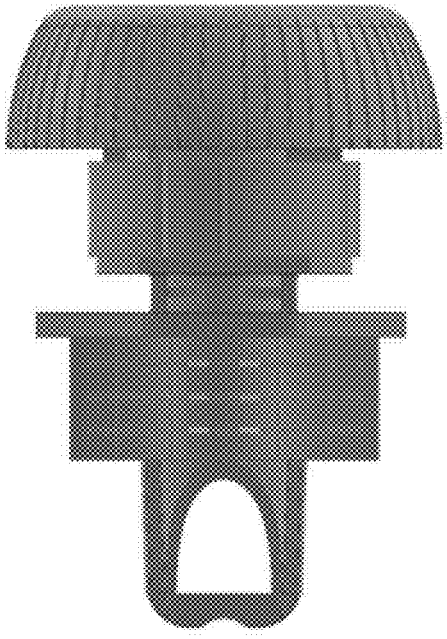
FIG. 36 is a front view of another closure of the present disclosure coupled to a straw.
Figure 37:
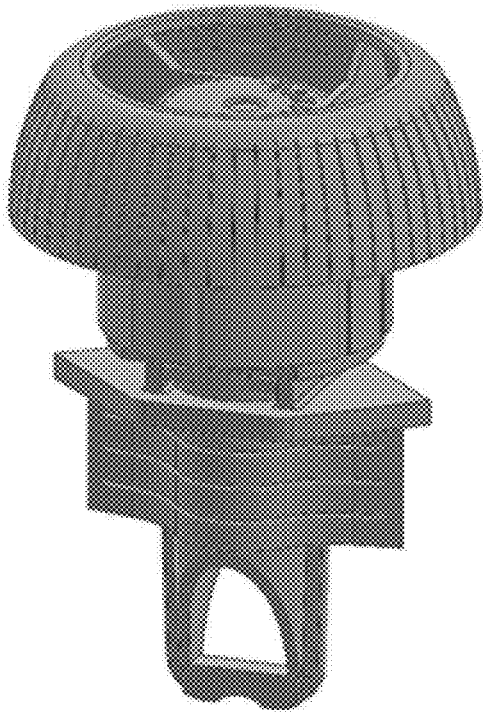
FIG. 37 is a perspective view of the closure of FIG. 36 coupled to the straw.
Figure 38:
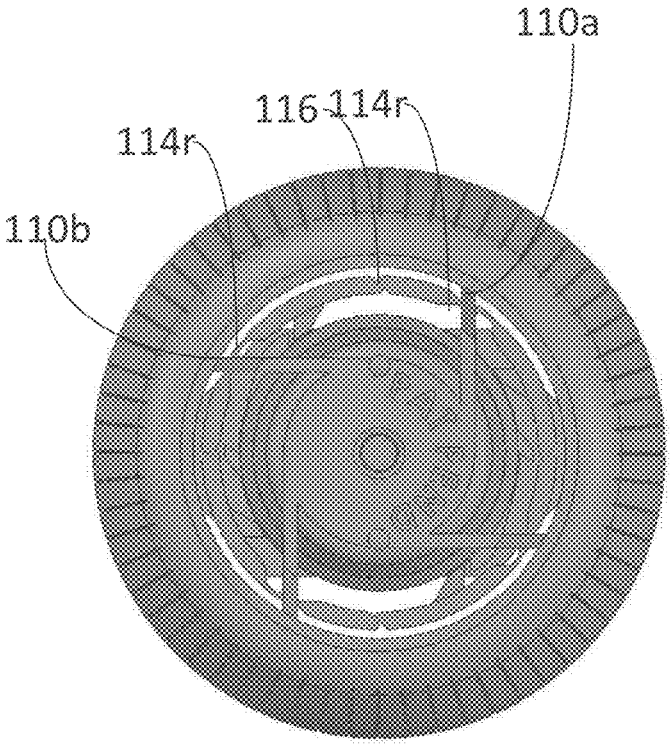
FIG. 38 is a top-down view of FIG. 36.

FIGS. 36-38 schematically show various views of an alternative of the cap 100 in accordance with illustrative embodiments of the invention. In a similar manner to FIGS. 33-35, FIGS. 36-38 include a break segment 116 formed as the tear strip 116 in the tab 114. However, the hinges 114*r* are internally facing, as opposed to other embodiments that have externally facing hinges 114*r* (e.g., FIGS. 33-35).

Figure 39:
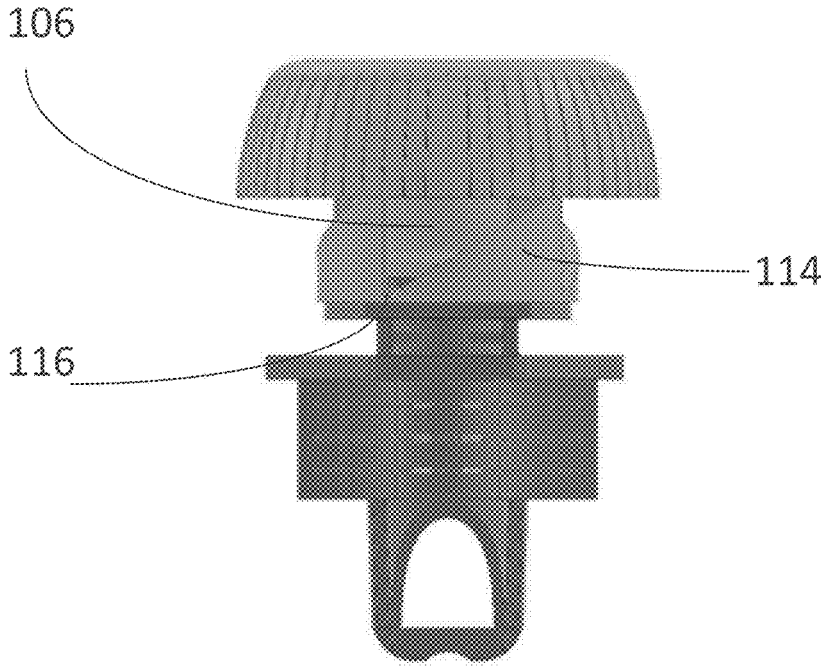
FIG. 39 is a front view of another closure of the present disclosure coupled to a straw.
Figure 40:
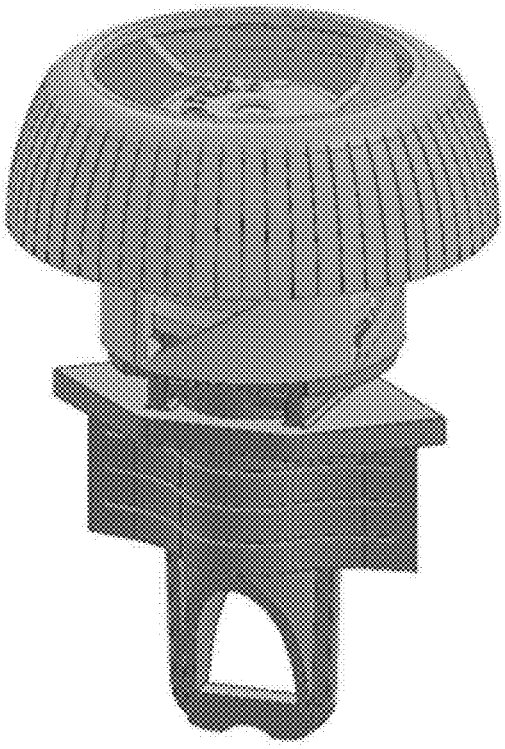
FIG. 40 is a perspective view of the closure of FIG. 39 coupled to the straw.
Figure 41:
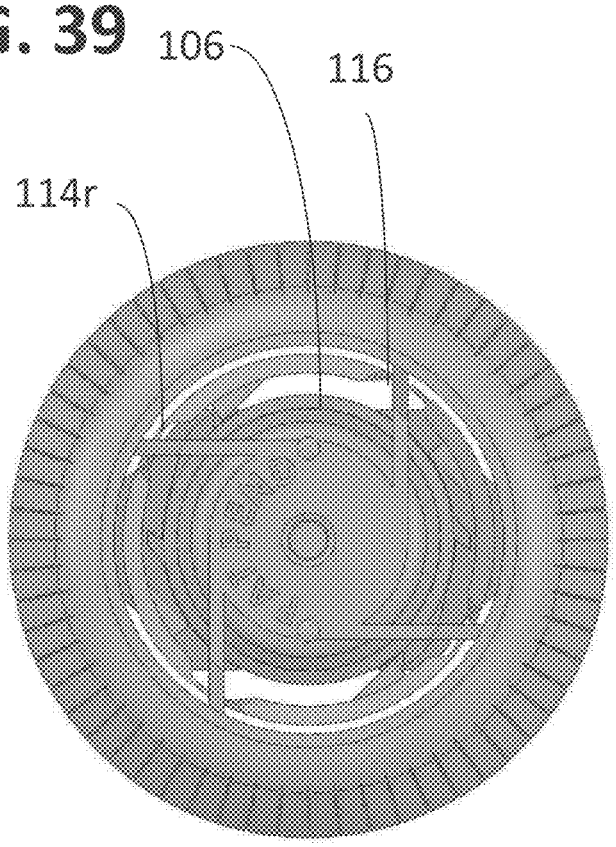
FIG. 41 is a top-down view of FIG. 39.

FIGS. 39-41 schematically show various views of an alternative of the cap 100 in accordance with illustrative embodiments of the invention. The tab 114 has a partially exposed shape (e.g., a triangular shape) that allows the user to view the inner cap 106. The inner cap 106 may be exposed even prior to breaking the break segment 116.

Figure 42:
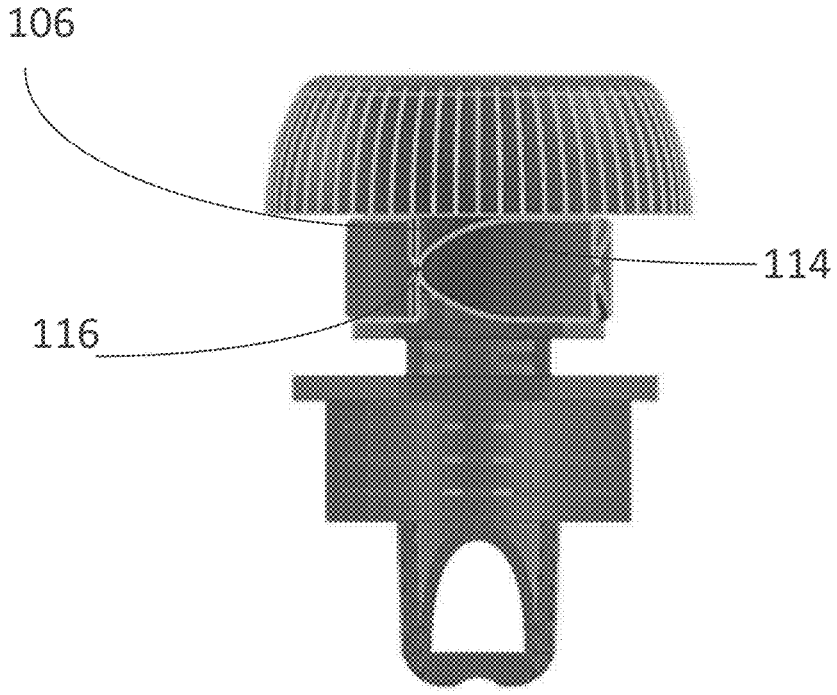
FIG. 42 is a front view of another closure of the present disclosure coupled to a straw.
Figure 43:
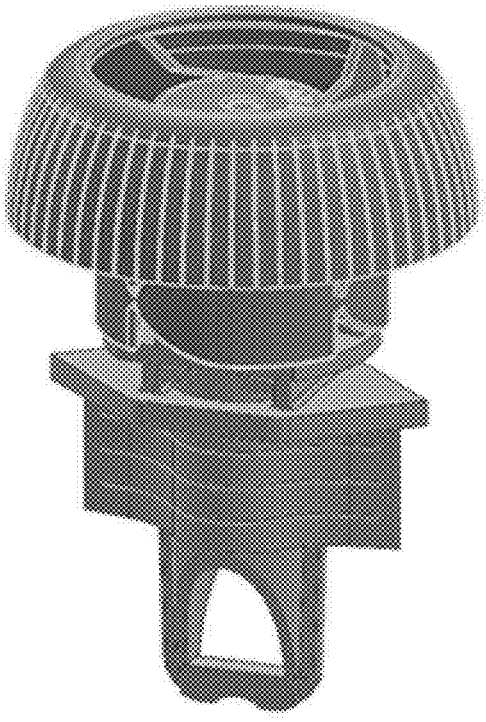
FIG. 43 is a perspective view of the closure of FIG. 42 coupled to the straw.
Figure 44:
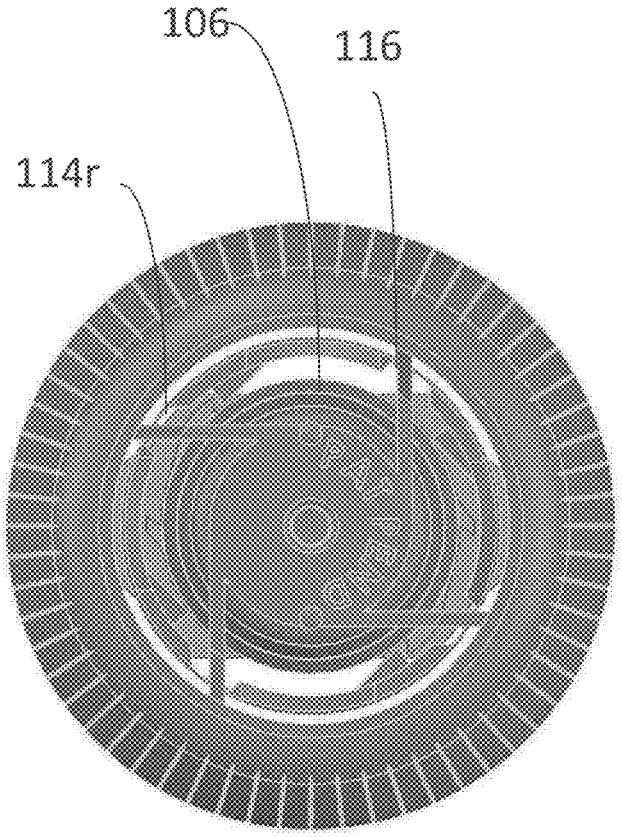
FIG. 44 is a top-down view of FIG. 42.

FIGS. 42-44 schematically show various views of an alternative of the cap 100 in accordance with illustrative embodiments of the invention. In various embodiments, the tab 114 has a contoured or parabolic shape leading to a break segment 116. The contoured shape of the tab 114 partially exposes the inner cap 106. The break segment 116 may be positioned at the middle of the height Ht of the tab 114.

In various embodiments, the cap 100 and the straw 102 may be provided as a kit or a system. In some embodiments, the cap 100 and the straw 102 may be provided in a sealed configuration. The container (e.g., a pouch) may be filled, and then the cap 100 and the straw 102 may be sealed to the container. Alternatively, the container may be filled with the straw 102 in place, and then the cap 100 may be threaded to the straw 102 and sealed. Furthermore, although a straw 102 with a hoop is shown in various embodiments, it should be understood that a variety of straws 102 may be used, including straws 102 without hoops.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents.

The illustrated and described systems and methods are in no way limiting. A person skilled in the art, in view of the present disclosures, will understand how to apply the teachings of one embodiment to other embodiments either explicitly or implicitly provided for in the present disclosures. Further, a person skilled in the art will appreciate further features and advantages of the present disclosure based on the above-described embodiments. Accordingly, the disclosure is not to be limited by what has been particularly shown and described, except as indicated by the appended claims.

What is claimed is:

1. A closure for a container, comprising:

an outer shell having a proximal end, a distal end, an inner surface, and an outer surface;

an inner cap having a proximal end, a distal end, an inner surface, and an outer surface;

a plurality of ribs extending from the inner cap to the outer shell; and a tamper-evident band encircling the distal end of the inner cap, the tamper-evident band being made up of a plurality of tamper-evident segments, each tamper-evident segment having a tab coupled with one of the plurality of ribs and a break segment, wherein a first end of the break segment is coupled with the tab and a second end of the break segment is coupled with an adjacent one of the plurality of ribs.

2. The closure of claim 1, wherein the tab of each of the plurality of tamper-evident segments is configured to pivot about the rib to which the first end of the tab is coupled when the outer shell is rotated relative to the inner cap.

3. The closure of claim 1, wherein the distal end of the outer shell is proximal to the tamper-evident band.

4. The closure of claim 1, wherein the plurality of tamper-evident segments comprises two segments or four segments.

5. The closure of claim 1, wherein a ratio of a maximum height of the outer shell to a height of one of the plurality of tabs is less than or equal 6:1.

6. The closure of claim 1, wherein a height of each of the tabs is substantially equal to or greater than a distance from a distal end of the outer shell to the distal end of the inner cap as measured along a proximal-distal axis of the closure.

7. The closure of claim 1, wherein each of the tabs includes a recessed portion at the first end thereof, the recessed portion connecting the tab to the one of the plurality of ribs.

8. The closure of claim 1, wherein each of the tabs includes at least one lug extending radially inwardly towards the inner cap, the at least one lug configured to engage the container to oppose relative rotation between the tamper-evident band and the container.

9. The closure of claim 1, wherein each tab is formed integrally with the rib coupled to the first end of the tab.

10. The closure of claim 1, wherein the break segment is a tear strip.

11. The closure of claim 1, wherein the second end of each tab has an arcuate shape.

12. The closure of claim 1, wherein the inner surface of the inner cap is at least partially threaded.

13. A closure for a container, comprising:

an outer shell having a proximal end, a distal end, an inner surface, and an outer surface;

an inner cap having a proximal end, a distal end, an at least partially threaded inner surface, and an outer surface;

a plurality of ribs extending from the inner cap to the outer shell, each of the plurality of ribs extending tangentially from the proximal end of the inner cap to the inner surface of the outer shell; and a tamper-evident band encircling the distal end of the inner cap, the tamper-evident band being made up of a plurality of tamper-evident segments, with each tamper-evident segment having a tab coupled at a first end to one of the plurality of ribs and a break segment extending between the tab and another one of the plurality of ribs.

14. The closure of claim 13, wherein the plurality of ribs comprises four ribs.

15. The closure of claim 13, wherein each of the plurality of ribs extends along the inner surface of the outer shell from the proximal end to the distal end of the outer shell.

16. The closure of claim 13, wherein each of the plurality of ribs extends along the outer surface of the inner cap from the proximal end of the inner cap to the distal end of the inner cap.

17. The closure of claim 13, wherein each tab pivots about a vertical axis of the rib to which the first end of the tab is coupled when the outer shell is rotated relative to the inner cap.

18. The closer of claim 13, wherein a ratio of a maximum height of the outer shell to a maximum height of the tab is less than or equal to 6:1, but greater than or equal to 1:10.

19. A closure for a container, comprising:

an outer shell having a proximal end, a distal end, an inner surface, and an outer surface;

an inner cap having a proximal end, a distal end, an inner surface, and an outer surface;

a plurality of ribs extending from the inner cap to the outer shell; and a tamper-evident band encircling the distal end of the inner cap, the tamper-evident band being made up of a plurality of tamper-evident segments, with each tamper-evident segment having a tab with a first end and a second end, the first end of the tab coupled to one of the plurality of ribs and the second end of the tab coupled to a break segment, the break segment extending between the second end of the tab and another one of the plurality of ribs, wherein a ratio of a maximum height of the outer shell to a maximum height of one of the plurality of tabs, as measured along a proximal-distal axis, is less than or equal 3.1.

20. The closure of claim 19, wherein the ratio of a maximum height of the outer shell to a maximum height of at least one of the plurality of tabs is approximately 1:1.

21. The closure of claim 19, wherein the distal end of the outer shell terminates proximally of a proximal end of the tab.

22. The closure of claim 19, wherein the tamper-evident band is distal to the distal end of the outer shell.

* * * * *